US007890032B2

(12) United States Patent
Endo et al.

(10) Patent No.: US 7,890,032 B2
(45) Date of Patent: Feb. 15, 2011

(54) DEVELOPING APPARATUS HAVING A SCRAPING MEMBER

(75) Inventors: Rie Endo, Kanagawa-ken (JP); Katsuhiro Sakaizawa, Numazu (JP); Ryuji Yamamoto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/579,616

(22) Filed: Oct. 15, 2009

(65) Prior Publication Data

US 2010/0046988 A1 Feb. 25, 2010

Related U.S. Application Data

(62) Division of application No. 11/429,982, filed on May 9, 2006, now Pat. No. 7,668,490.

(30) Foreign Application Priority Data

May 12, 2005 (JP) ..... 2005-140424
May 12, 2005 (JP) ..... 2005-140427
May 25, 2005 (JP) ..... 2005-153113

(51) Int. Cl.
*G03G 15/08* (2006.01)

(52) U.S. Cl. ..... 399/281; 399/283

(58) Field of Classification Search ..... 399/283, 399/281, 279, 265, 273
See application file for complete search history.

(56) References Cited

U.S. PATENT DOCUMENTS 5,047,805 A * 9/1991 Oka et al. ..... 399/105
5,424,817 A 6/1995 Imamiya et al.
5,519,472 A 5/1996 Ojima et al.
5,570,164 A * 10/1996 Yamamoto et al. ..... 399/283
5,570,166 A 10/1996 Ohzeki et al.
5,708,921 A 1/1998 Yagi et al.
6,070,039 A 5/2000 Yamaki et al.
6,229,980 B1 5/2001 Ogawa et al.
6,381,434 B1 4/2002 Yamamoto
6,751,423 B2 6/2004 Sakaizawa et al.
2004/0184843 A1 9/2004 Sato

FOREIGN PATENT DOCUMENTS

JP 57-210372 A 12/1982
JP 3-48877 A 3/1991
JP 8-137257 A 5/1996
JP 11-174839 A 7/1999
JP 11-212365 A 8/1999

* cited by examiner

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

A developing apparatus has a developer carrying member carrying a developer thereon, a developer supplying member for supplying the developer to the developer carrying member, and a scraping member for contacting the developer carrying member upstream of the closest position between the developer carrying member and the developer supplying member with respect to the movement direction of the developer carrying member to thereby scrape off the developer from the developer carrying member. There is formed a developer supplying portion surrounded by the scraping member, the developer carrying member and the developer supplying member for supplying the developer from the developer supplying member to the developer carrying member, and the developer scraped off by the scraping member is conveyed to a collecting passage differing from the closest position.

13 Claims, 16 Drawing Sheets

DEVELOPING APPARATUS HAVING A SCRAPING MEMBER

This application is a divisional of U.S. patent application Ser. No. 11/429,982, filed May 9, 2006.

BACKGROUND OF THE INVENTION

1. Field of the Invention

The invention relates to a developing apparatus for use in an image forming apparatus such as a laser printer, a copying machine or a facsimile apparatus utilizing an electrophotographic printing method or an electrostatic recording method.

2. Description of Related Art

In an image forming apparatus utilizing, for example, an electrophotographic printing method, the surface of an electrophotographic photosensitive member (photosensitive member), which is an image bearing member, is charged by charging means, whereafter light is applied to the surface of this photosensitive member, whereby an electrostatic image (latent image) is formed on the surface of the photosensitive member. This electrostatic image is developed as a toner image with the toner of a developer supplied from a developing apparatus. This toner image is transferred from the photosensitive member to a transfer material (such as recording paper, an OHP sheet or cloth) by transferring means, and thereafter is subjected to a fixing process by fixing means.

A developing method for making the electrostatic image into a toner image is classified broadly into mono-component development and dual-component development. In mono-component development, a mono-component developer substantially comprising only resin toner particles (toner) is used as a developer. On the other hand, in the dual-component development, use is made of a dual-component developer chiefly provided with resin toner particles (toner) and magnetic carrier particles (carrier). In both of the mono-component developer and the dual-component developer, an extraneous additive (auxiliary particles) is sometimes added to the toner particles for the stabilization of the charge ability of the toner and the adjustment of the fluidity of the toner.

As the mono-component development, the following dry type mono-component contact developing method has been proposed and put into practical use. This method uses a non-magnetic mono-component developer as the developer. A developer carrying member carrying the developer thereon and conveying it to a photosensitive member is urged against or brought into contact with the rotating photosensitive member to thereby develop the electrostatic image. There is also a non-contact developing method of effecting development with the developer carrying member being out of contact with the photosensitive member.

The developing method using the nonmagnetic mono-component developer does not require a magnetic material for the developer, and facilitates the simplification and downsizing of an apparatus. Also, the developing method using the nonmagnetic mono-component developer is good in color taste and therefore has many advantages including the ease of application to a full-color image forming apparatus.

In a developing apparatus utilizing the nonmagnetic mono-component developer, the toner cannot be supplied to the developer carrying member by a magnetic force and therefore, other means for supplying the toner to the developer carrying member is required.

In the developing apparatus using such a nonmagnetic mono-component developer, a method using a supplying roller as a developer supplying member, which does not contact the developer carrying member has been proposed as means for supplying a toner to the developer carrying member (see Japanese Patent Application Laid-open No. H3-48877 and Japanese Patent Application Laid-open No. H11-212365).

That is, as shown in FIG. 11 of the accompanying drawings, such a developing apparatus 201 has a rotated developer carrying member 204, a seal member 211 contacting the developer carrying member 204, a supplying roller 205 opposed to the developer carrying member 204 with a predetermined interval therebetween downstream of the seal member 211 with respect to the movement direction of the surface of the developer carrying member for supplying a toner to the developer carrying member 204 while contacting with the toner, a holding member 212 for supporting the seal member 211, and a scraping member 213 supported by the holding member 212 for scraping off the toner held on the outer peripheral portion of the supplying roller 205. A space (containing portion) surrounded by the developer carrying member 204, the seal member 211, the holding member 212, the scraping member 213 and the supplying roller 205 forms a toner supplying portion 214 for supplying the toner contained therein onto the developer carrying member 204. As the developer carrying member 204, use has heretofore been made of a belt sleeve or a metal sleeve or an elastic roller or the like having a circumferential length slightly greater than the circumferential length of the rotary member and mounted around the rotary member.

A method of supplying the toner to the developer carrying member 204 in the developing apparatus 201 of such a construction is as follows. The toner held on the outer peripheral portion of the supplying roller 205 is conveyed on the basis of the rotation of the supplying roller 205, is scraped off by the scraping member 213 and is held in the toner supplying portion 214. Also, the amount of toner t contained in the toner supplying portion 214 is increased by the rotation of the supplying roller 205 with a result that toner pressure (powder pressure) there is kept high. By this high toner pressure, a necessary amount of toner is supplied to the developer carrying member 204 contacting the toner contained in the toner supplying portion 214.

Any residual toner on the developer carrying member 204 after the termination of the developing step (namely, after the passage through the contact portion with or the opposed portion to the photosensitive member) passes through the gap between the developer carrying member 204 and the seal member 211, and is returned to the toner supplying portion 214.

Here, when the toner newly supplied onto the developer carrying member 204 and the residual toner on the developer carrying member 204 after the developing step are mixed together, there occurs an image fault. So, heretofore, the seal member 211 is formed by an electrically conductive elastic member of sponge structure, such as electrically conductive moltopren, to thereby constitute a charge eliminating member, or a charge eliminating sheet, such as electrically conductive Teflon sheet, is been stuck on the upper portion of the seal member 211 to thereby constitute a charge eliminating member. A bias is applied to this charge eliminating member to thereby effect the charge elimination of the residual toner on the developer carrying member 204. Thereby, after the developing step, the toner is stripped off from the developer carrying member, whereafter a layer of new toner is formed on the developer carrying member 204.

In the conventional developing apparatus 201 as described above, however, even the residual toner on the developer carrying member 204 after the termination of the developing step, even if it passes the seal member 212 and thereafter is stripped off from the developer carrying member 204, is returned to the toner supplying portion 214 without separating from the developer carrying member 204. Thus, this toner returned to the toner supplying portion 214 is immediately supplied again onto the developer carrying member 204 and is used for development.

Now, the toner on the developer carrying member 204 is subjected to frictional contact with a developer regulating member 206, such as an elastic blade, and the photosensitive member. Therefore, if as described above, the toner returned to the toner supplying portion 214 is immediately supplied again onto the developer carrying member 204 and is used for development, when the apparatus is continuously used, heat and damage due to the frictional contact are accumulated in the toner. Then, the extraneous additive adhering to the outer peripheral portion of the toner is embedded into the toner or the extraneous additive separates from the toner, thus causing so-called toner deterioration. Accordingly, when the apparatus is continuously used, the fusion of the toner occurs to the developer regulating member 206. As the result, a streak-shaped irregular portion of toner occurs on the developer carrying member 204, and a streak-shaped density difference sometimes appear in an image.

Also, when as described above, a bias is applied to the charge eliminating member to strip off the residual toner on the developer carrying member 204 from the developer carrying member 204, the separation of the extraneous additive from the toner is liable to occur due to the electrical interference. Therefore, when the toner is continuously used, a reduction in the triboelectricity of the toner (the charge amount per unit weight of the toner) and the degree of aggregation increase, and in the image formation operation during the next round of the rotation of the developer carrying member 204, the density of the image is sometimes changed to thereby cause an image defect, such as a ghost image.

Thus, in the developing apparatus in which the toner is conveyed to the toner supplying portion 214 by the supplying roller 205, and the toner is supplied to the developer carrying member 204 with high toner pressure, it has heretofore been required to suppress an image defect such as a streak or a ghost caused by the residual toner on the developer carrying member 204 being immediately used for development after the passage through a developing area.

Also, to obtain the desired image density, there has been no way but to increase the supplying ability of the supplying roller to thereby supply more toner to the toner supplying portion. If the toner is not sufficiently supplied to the developer carrying member, imaging problems, such as a reduction in image density, a blank area and an uneven density, will occur.

For example, to increase the supplying capability for supplying the toner to the toner supplying portion, there has been proposed a method of making the surface movement speed (peripheral speed) of the supplying roller higher than the peripheral speed of a developing roller as the developer carrying member. To make the peripheral speed of the supplying roller higher than the peripheral speed of the developing roller, there is a method of making the outer diameter of the supplying roller larger than that of the developing roller to thereby make the number of revolutions of the supplying roller equal to the number of revolutions of the developing roller. Also, when the outer diameter of the supplying roller is equal to or less than the outer diameter of the developing roller, to make the peripheral speed of the supplying roller higher than the peripheral speed of the developing roller, the number of revolutions of the supplying roller must be made greater than the number of revolutions of the developing roller.

However, increasing the outer diameter of the supplying roller makes it difficult to downsize the developing apparatus, which has become important in recent years, and this is not preferable. Particularly, when the desire to produce a color image is taken into account, there is required a developing apparatus of four colors, i.e. yellow, cyan, magenta and black and therefore, the entire image forming apparatus is liable to become bulky.

Also, when the outer diameter of the supplying roller is made small and the number of revolutions thereof is made great, the mechanical load increases and thus, the driving portion of the apparatus becomes bulky from the necessity of performing high-speed rotation.

Further, when the printing speed is made high, the peripheral speed of the developing roller also becomes high and therefore, there is also a limitation in the peripheral speed of the supplying roller.

As described above, in the conventional developing apparatus, the supplying capability of the supplying roller must be increased in order to obtain the desired density, and such a goal has been unsuitable for downsizing the apparatus and achieving a higher speed operation.

SUMMARY OF THE INVENTION

It is an object of the present invention to provide a developing apparatus which can suppress imaging problems due to the deterioration of a developer.

It is another object of the present invention to provide a developing apparatus which can prevent the residual developer on a developer carrying member from being immediately supplied again onto the developer carrying member after the passage through a developing area.

It is another object of the present invention to provide a developing apparatus which can increase the capability of supplying a developer to a developer carrying member, by a simple construction.

It is another object of the present invention to provide a developing apparatus which can obtain the desired image density without increasing the driving speed of a developer supplying member for conveying a developer to a developer supplying portion, in which the supply of the developer to a developer carrying member does not increase more than necessary.

Further objects and features of the present invention will become more apparent from the following detailed description when read with reference to the accompanying drawings.

DETAILED DESCRIPTION OF THE PREFERRED EMBODIMENTS

A developing apparatus and an image forming apparatus according to the present invention will hereinafter be described in greater detail with reference to the drawings.

Embodiment 1

Image Forming Apparatus

Figure 5:
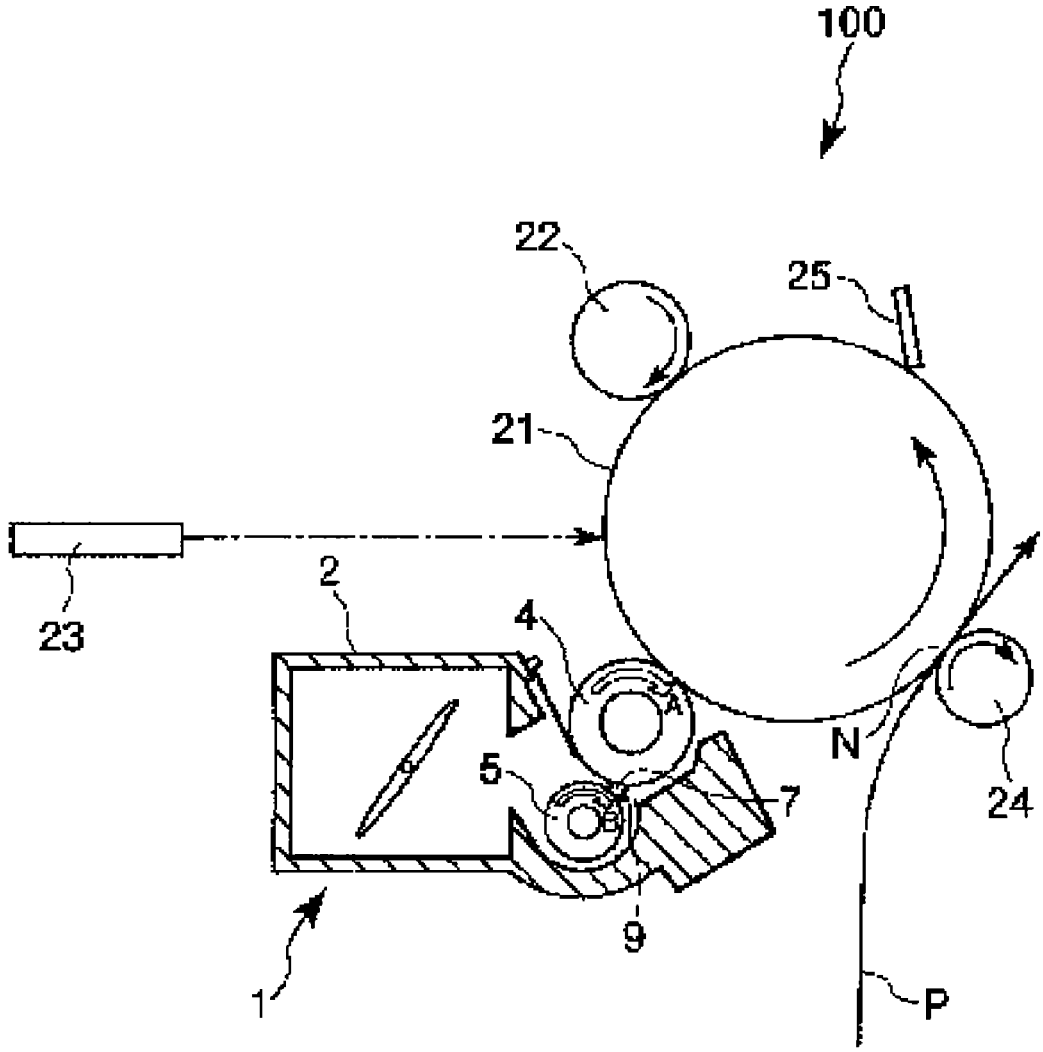
FIG. 5 is a view schematically showing the essential portions of an embodiment of an image forming apparatus according to the present invention.

Reference is first had to FIG. 5 to describe the general construction and operation of an image forming apparatus provided with a developing apparatus constructed in accordance with the present invention. In the present embodiment, the image forming apparatus 100 is a laser beam printer which forms an image on a transfer material (such as recording paper, an OHP sheet or cloth) by the utilization of an electrophotographic printing method in accordance with an image information signal from a personal computer, an original reading apparatus or the like communicably connected to an image forming apparatus main body (apparatus main body) and outputs the image. Also, the image forming apparatus 100 according to the present embodiment is provided with a developing apparatus 1 using a nonmagnetic mono-component developer (toner).

The image forming apparatus 100 has a drum-shaped photosensitive member, i.e., a photosensitive drum 21, as an image bearing member. The photosensitive drum 21 is rotatably driven in the direction indicated by the arrow. The surface of the rotated photosensitive drum 21 is charged to a predetermined polarity (a negative polarity in the present embodiment) and potential by a charging roller 22 as charging means. The charged surface of the photosensitive drum 21 is scanned and exposed in accordance with the image information signal by a laser scanner 23 as exposing means (image writing-in means). As a result, an electrostatic image is formed on the photosensitive drum 21. The electrostatic image formed on the photosensitive drum 21 is then supplied with the toner of a developer by the developing apparatus 1, and is visualized as a visible image, i.e., a toner image.

On the other hand, in timed relationship with the formation of the toner image on the photosensitive drum 21, a transfer material P is conveyed from a transfer material supplying portion (not shown) to a transferring portion N in which the photosensitive drum 21 and a transfer roller 24 as transferring means are opposed to each other. Then, the toner image on the photosensitive drum 21 is transferred onto the transfer material P by the action of the transfer roller 24. At this time, a bias of a polarity opposite to the regular charging polarity (the negative polarity in the present embodiment) of the toner is applied from transfer bias outputting means (not shown) to the transfer roller 24.

The transfer material P to which the toner image has been transferred is thereafter conveyed to a fixing device (not shown) as fixing means. The toner on the transfer material P is heated and pressurized by the fixing device, whereby it is fixed on the transfer material P. Thereafter, the transfer material is discharged out of the apparatus main body.

Also, any residual toner on the photosensitive drum 21 after the transfer of the toner image is removed by a cleaning blade 25 as cleaning means, and is collected into a waste toner container (not shown).

[Developing Apparatus]

A description will now be provided of the developing apparatus provided in the image forming apparatus 100 according to the present embodiment.

Figure 1:
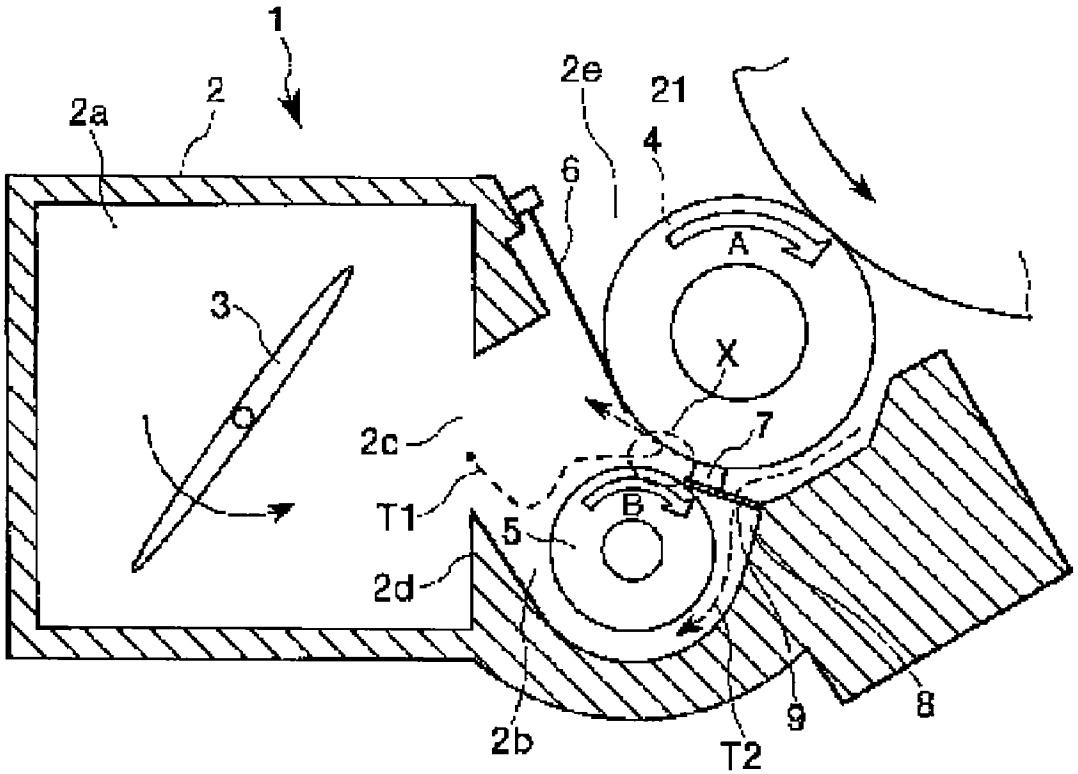
FIG. 1 is a schematic cross-sectional view of an embodiment of a developing apparatus according to the present invention.

FIG. 1 is a schematic cross-sectional view of the developing apparatus 1 in the present embodiment. In the present embodiment, the developing apparatus 1 uses a nonmagnetic mono-component developer, i.e., toner, as a developer. The developing apparatus 1 has a container (developer container frame) 2. The container 2 has a toner containing portion (developer containing portion) 2*a* in which the toner is contained, and a developing chamber 2*b* in which developing means, such as a developer carrying member, which will be described later, is disposed. An agitating vane 3 as a developer agitating and conveying member is disposed in the toner containing portion 2*a*. By the rotation of this developer conveying member 3, the toner in the toner containing portion 2*a* is supplied to the developing chamber 2*b*. The toner containing portion 2*a* and the developing chamber 2*b* communicate with each other by a toner conveying opening portion 2*c* and also, are partitioned by a partition wall 2*d* formed so as to protrude upwardly from the bottom surface of the container 2. As a result, a desired amount of toner can be held in the developing chamber 2*b*.

The developing chamber 2*b* of the container 2 partly opens at a portion thereof opposed to the photosensitive drum 21, and a developing roller 4 as a developer carrying member is disposed so as to be partly exposed from the opening portion 2*e*. The developing roller 4 is rotatably supported by the container 2. The developing roller 4 and the photosensitive drum 21 are rotated so that in the contact portion therebetween, the movement directions of the surfaces (outer peripheral portions) thereof may be a forward direction. Also, in the developing chamber 2*b*, a supplying roller 5 as a developer supplying member is disposed out of contact with and in opposed relationship with the developing roller 4. The supplying roller 5 is rotatably supported by the container 2. The developing roller 4 and the supplying roller 5 are rotated so that in the opposed portion therebetween, the movement directions of the surfaces (outer peripheral portions) thereof may be opposite directions. Also, downstream of the closest position between the developing roller 4 and the supplying roller 5 with respect to the surface movement direction of the developing roller 4, a developing blade 6 as a developer regulating member is disposed in contact with the developing roller 4.

In the present embodiment, the developing apparatus 1 further has a scraping wall member 7 installed between the developing roller 4 and the supplying roller 5 downstream of a developing area for supplying the toner from the developing roller 4 to the photosensitive drum 21 with respect to the surface movement direction of the developing roller 4, and upstream of the closest position between the developing roller 4 and the supplying roller 5 with respect to the surface movement direction of the developing roller 4, and having at least a portion thereof abutting against the developing roller 4. Also, the developing apparatus 1 has a collecting passage 9 for collecting the toner scraped off by the scraping wall member 7.

The apparatus is designed such that by such a construction, the toner scraped off from the developing roller 4 by the scraping wall member 7 can be returned to the toner container portion 2*a* with the aid of the rotation of the supplying roller 5. On the other hand, a space (containing portion) surrounded by the developing roller 4, the supplying roller 5 and the scraping wall member 7 constitutes a toner supplying portion (developer supplying portion X for holding the toner between the developing roller 4 and the supplying roller 5. In this toner supplying portion X, the toner conveyed to the portion opposed to the developing roller 4 by the rotation of the supplying roller 5 is urged against the developing roller 4, and the toner is supplied onto the developing roller 4. A description of this embodiment will hereinafter be provided in greater detail.

(Developer Carrying Member)

The developing roller 4 as the developer carrying member carries the toner thereon and conveys it to the photosensitive drum 21. The developing roller 4 is disposed in contact with the photosensitive drum 21, and is rotated in the direction indicated by the arrow A. In the present embodiment, the developing roller 4 is an elastic roller comprising a cylindrical solid metal bar (mandrel) having an outer diameter of 8 mm, and an elastic layer laminated to a thickness of about 4 mm on the outer periphery thereof so as to have an outer diameter of 16 mm. As the elastic layer, use can be made of popular rubber such as silicone rubber, urethane rubber, butyl rubber, epichlorohydrin rubber, nitrite butadiene rubber or ethylene propylene diene rubber (EPDM).

As regards the developing roller 4, the elastic layer itself may be used as the outermost layer, but with the chargeability of the toner taken into account, the surface layer may be formed of a material differing from the elastic layer. When a toner of negative chargeability is used, urethane resin, polyamide resin, silicone resin or the like is usable as the surface layer. When a toner of positive chargeability is used, fluorine resin or the like is usable as the surface layer.

In the present embodiment, as the developing roller 4, use is made of a roller comprising an elastic layer formed of silicone rubber, and urethane resin applied thereto as a surface layer of about 20 μm, and having surface roughness of ten-point mean roughness $R_Z$ (JIS B 0601) 5-8 μm, and an electrical resistance value of $1.0\times10^3$–$2.0\times10^7\Omega$.

For the measurement of the surface roughness, use was made of a surface roughness testing machine "SE-30H" produced by Kosaka Laboratory Ltd. The electrical resistance value of the developing roller 4 was measured in the following manner. The electrical resistance value of the developing roller 4 was calculated from the current value when a stainless steel cylinder member having an outer diameter of 30 mm and the developing roller 4 were opposed to each other in contact with each other and a DC voltage of 100 V was applied to between the mandrel of the developing roller 4 and the stainless steel cylinder member.

Also, development bias outputting means is connected to the developing roller 4. During the developing operation, by the action of an electric field by a development bias applied from this development bias outputting means to the developing roller 4, the toner on the developing roller 4 is supplied onto the photosensitive drum 21 in accordance with the electrostatic image thereon. In the present embodiment, reversal development is used, and the toner charged to the same polarity (the negative polarity in the present embodiment) as the charging polarity of the photosensitive drum 21 is made to adhere to a portion (light portion) on the photosensitive drum 21 in which charges are attenuated by exposure.

(Developer Regulating Member)

The developing blade 6 as the developer regulating member regulates the amount of toner coating the developing roller 4. In the present embodiment, the developing blade 6 is formed by a thin metal plate, which is a plate-shaped elastic member. The developing blade 6, by the utilization of the spring elasticity of this thin metal plate, is brought into contact with the developing roller 4 with predetermined abutting pressure. As the material of the thin metal plate, use can be made of stainless steel, phosphor bronze or the like. In the present embodiment, a thin plate of phosphor bronze having a thickness of 0.1 mm was used as the developing blade 6.

(Developer Supplying Member)

The supplying roller 5 as the developer supplying member conveys the toner to the developing roller 4. The supplying roller 5 is disposed out of contact with and in opposed relationship with the developing roller 4, and is rotated in the direction indicated by the arrow B. That is, the developing roller 4 and the supplying roller 5 are rotated so that in the opposed portion therebetween, the surface movement directions thereof may be opposite directions.

In the present embodiment, as the supplying roller 5, use was made of an aluminum bar having an outer diameter of 10 mm and surface roughness Rz 2.0 μm. The supplying roller 5 is adapted to be capable of supplying the toner over a range beyond a developing area in the axial direction of the developing roller 4 (a direction crossing the surface movement direction).

The supplying roller 5 is not particularly limited in its material and shape if it can convey the toner to the toner supplying portion X. However, the surface roughness Rz thereof should preferably be 1 μm-10 μm. If the surface roughness Rz is less than 1 μm, the toner conveyance amount becomes liable to be small. Also, if the surface roughness Rz exceeds 10 μm, unevenness becomes liable to occur to conveyance.

The peripheral speed (surface movement speed) of the supplying roller 5 should preferably be 70-300% of the peripheral speed of the developing roller 4. If this peripheral speed ratio is less than 70%, a desired amount of toner cannot be conveyed and there is the possibility of resulting in an image of low density. Also, if this peripheral speed ratio exceeds 300%, a mechanical load will increase and the driving portion may become bulky. In the present embodiment, the peripheral speed of the developing roller 4 was 120 mm/sec., and the peripheral speed of the supplying roller 5 was 89.3 mm/sec. (74.4% or the peripheral speed of the developing roller 4).

(Scraping Wall Member)

In the present embodiment, elastomeric foam was used as the scraping wall member. More specifically, in the present embodiment, as the scraping wall member 7, use was made of open-cell polyurethane foam of a rectangular cross-sectional shape having a width (width in a direction orthogonal to the axial direction of the developing roller 4 when installed in the developing apparatus 1) of 3 mm. and a height (height in the direction of the gap between the developing roller 4 and the supplying roller 5 when installed in the developing apparatus 1) of 3 mm in the state before installed in the developing apparatus 1. Also, the scraping wall member 7 has a length extending substantially in parallel to the axial direction of the developing roller 4 substantially over the entire toner carrying area on the developing roller 4 in a state installed in the developing apparatus 1. The scraping wall member 7 is supported by a holding member 8, which will be described later, and is disposed upstream of the closest portion between the developing roller 4 and the supplying roller 5 with respect to the surface movement direction of the developing roller 4.

Figure 2:
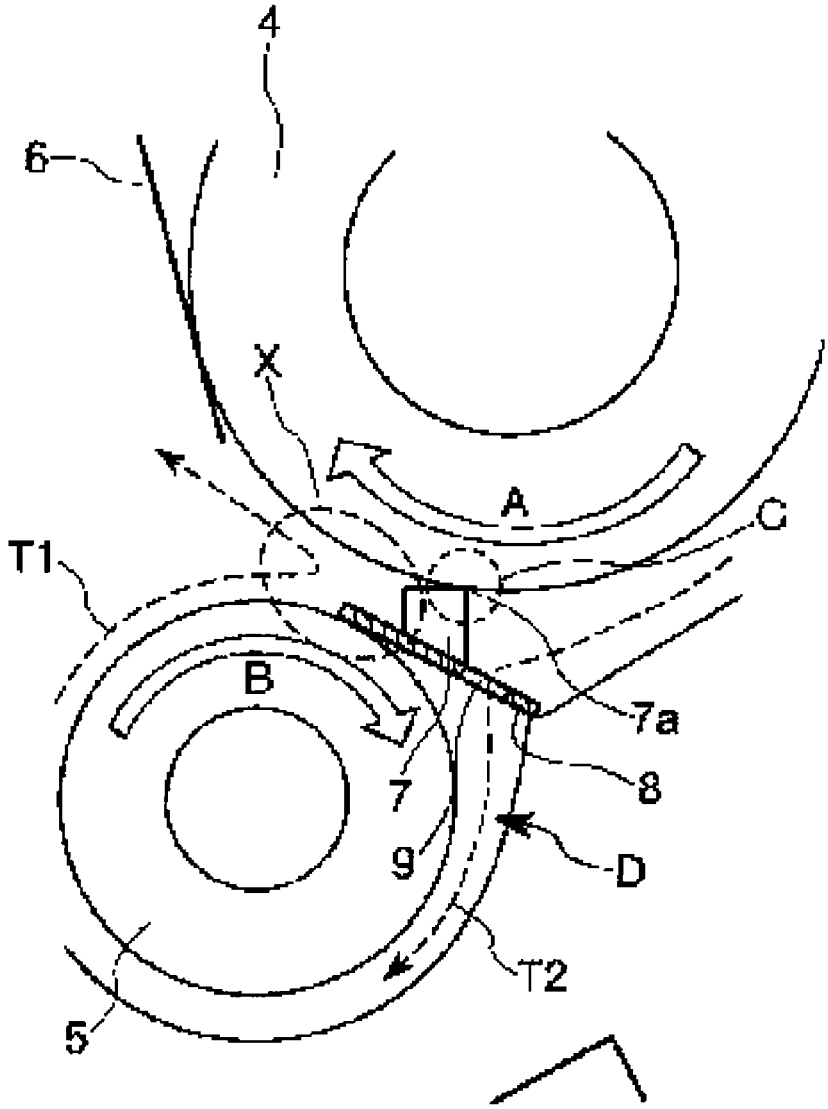
FIG. 2 is an enlarged cross-sectional view of the vicinity of a toner supplying and scraping portion in the developing apparatus of FIG. 1.

FIG. 2 shows on an enlarged scale a portion in which the toner supply to the developing roller 4 and the stripping-off of the toner from the developing roller 4 are effected. As shown in FIG. 2, the scraping wall member 7 is provided with at least one corner portion, and is disposed so that the corner portion 7*a* on the upstream side with respect to the surface movement direction of the developing roller 4 may abut against the developing roller 4 to thereby form a scraping portion C. By the corner portion 7*a* of the scraping wall member 7 abutting against the developing roller 4, it becomes possible to scrape off the toner carried on the developing roller 4 by the corner portion 7*a*. Therefore, almost all of the toner on the developing roller 4 is scraped off without passing between the developing roller 4 and the scraping wall member 7. In the present embodiment, the toner scraped off from the developing roller 4 falls and passes through the collecting passage 9 formed in the holding member 8 which will be described later, and is directed into a range D which the conveying action of the supplying roller 5 reaches.

The cell structure of the urethane foam of the scraping wall member 7 can easily catch the toner, and works advantageously for the scraping property of the residual toner on the developing roller 4 which has not contributed to development. The scraping property of this cell structure is not restricted to urethane foam, but can also be obtained by using foamed rubber or the like formed by foaming silicone rubber, ethylene propylene diene rubber (EPDM rubber) or the like. Also, elastomeric foam is not restricted to open-cell foam, but it is also possible to use closed-cell elastomeric foam.

The scraping wall member 7 forms a space, i.e., a toner supplying portion X, surrounded by this scraping wall member 7, the supplying roller 5 and the developing roller 4, and has the role of forming such a toner flow path as indicated by broken-line arrow T1. That is, the toner supplied from the toner containing portion 2*a* to the developing chamber 2*b* by the rotation of the agitating vane 3 is conveyed toward the toner supplying portion X by the rotation of the supplying roller 5. Then, the toner conveyed to the toner supplying portion X is conveyed toward the abutting portion between the developing blade 6 and the developing roller 4 by the rotation of the developing roller 4. At this time, the toner conveyed by the supplying roller 5 is pushed into the toner supplying portion X and is urged against the developing roller 4. The toner urged against the developing roller 4 also serves to supply the toner to the developing roller 4.

In the present embodiment, the gap between the developing roller 4 and the supplying roller 5 is 1.0 mm. In the present embodiment, the scraping wall member 7 formed of urethane foam has a height greater than the gap between the developing roller 4 and the supplying roller 5. Accordingly, the scraping wall member 7, when in a state installed in the developing apparatus 1, is compressed and its abutting pressure against the developing roller 4 increases. Therefore, the toner conveyed by the supplying roller 5 is effectively intercepted by the scraping wall member 7. Then, in the space, i.e., the toner supplying portion X, closed by the developing roller 4, the scraping wall member 7 and the supplying roller 5, the toner is urged against the developing roller 4. As a result, it becomes possible for the toner to be efficiently supplied to the developing roller 4.

Figure 3:
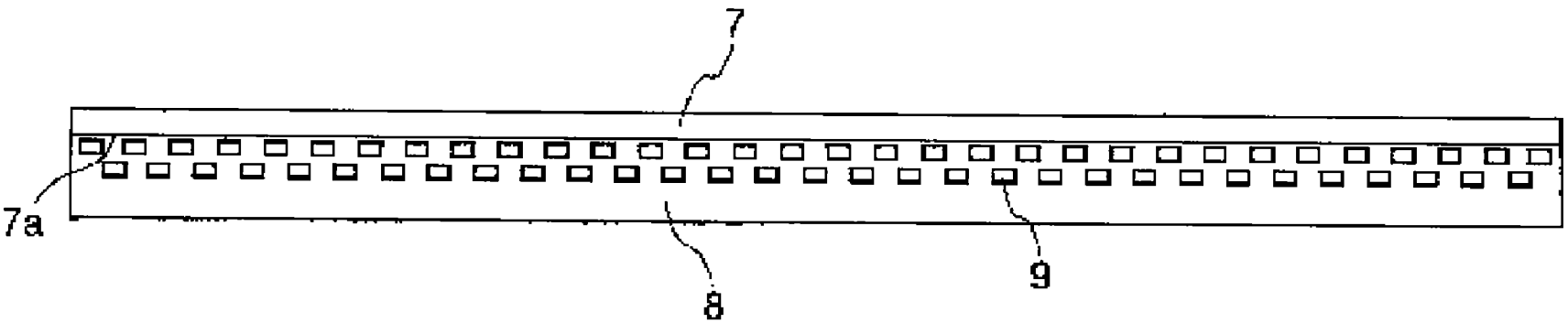
FIG. 3 is a plan view of an embodiment of a holding member on which a scraping wall member constructed in accordance with the present invention is mounted.

FIG. 3 shows the holding member 8 as a holding portion on which the scraping wall member 7 is mounted. In the present embodiment, the holding member 8 is plate-shaped, and holds the scraping wall member 7 and also, has a collecting passage 9 for collecting the toner stripped off from the developing roller 4 after the termination of the developing step (namely, after the passage through the contact portion with the photosensitive drum 21). The holding member 8 is not restricted thereto, but use can be suitably made of resin film which is a plate-shaped elastic member. In the present embodiment, as the holding member 8, use is made of film of polyethylene terephthalate having a thickness of 100 μm. The holding member 8 is disposed so that the longitudinal direction thereof may be along the axial direction of the developing roller 4. In a direction along the surface movement direction of the developing roller 4 (a direction crossing the axial direction of the developing roller 4), the scraping wall member 7 is mounted on one end portion of the holding member 8. That end portion of the holding member 8 on which the scraping wall member 7 is installed is in contact with the supplying roller 5. As a result, in the present embodiment, the downstream side of the toner supplying portion X with respect to the surface movement direction of the supplying roller is substantially hermetically sealed. Also, in the direction along the surface movement direction of the developing roller 4, the other end portion of the holding member 8 is mounted on the container (developer container frame) 2. As a result, this end portion side of the holding member 8 is connected to the container 2.

In the present embodiment, as the collecting passage 9, a plurality of apertures extending through the holding member 8, i.e., apertures having a width (width in a direction orthogonal to the axial direction of the developing roller 4 when installed in the developing apparatus 1) of 2.5 mm and a length (the axial length of the developing roller 4 when installed in the developing apparatus 1) of 3.0 mm are formed over the longitudinal direction of the holding member 8. Further describing, in the present embodiment, the collecting passage 9 is provided so that in the longitudinal direction of the holding member 8 (a direction orthogonal to the surface movement direction of the developing roller 5), there may be no non-apertured portion substantially over the entire area except the opposite end portions. In the present embodiment, as shown in FIG. 3, as the collecting passage 9, two rows of apertures along the axial direction of the developing roller 4 are alternately formed in a direction crossing the axial direction of the developing roller 4. As a result, non-apertured portions are prevented from being absent in the longitudinal direction of the holding member 8. Also, the collecting passage 9 is provided just beside the scraping wall member 7.

Figure 4:
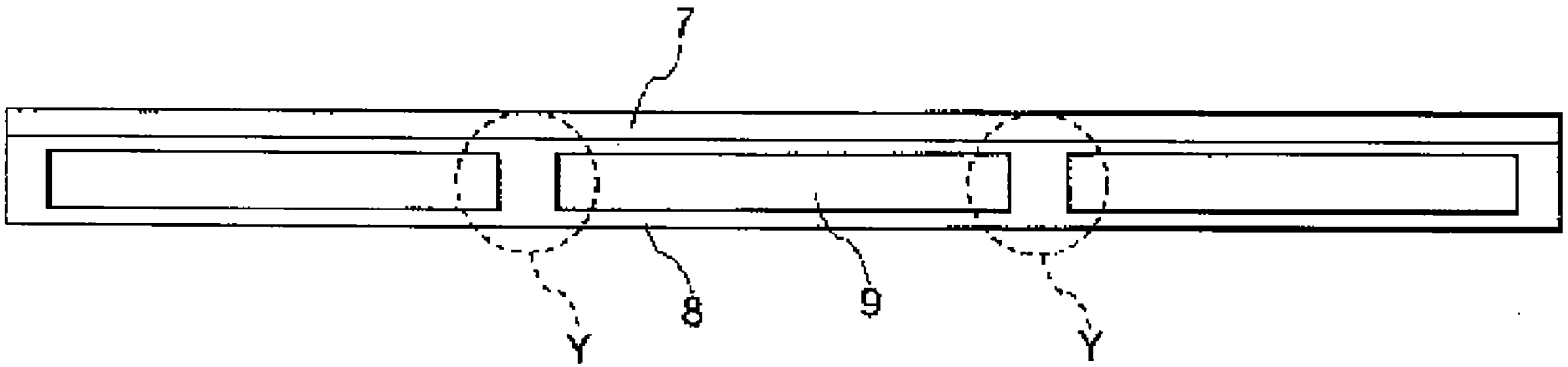
FIG. 4 is a plan view of the holding member for illustrating the construction of a collecting passage provided in the holding member.

Here, if as shown in FIG. 4, in the longitudinal direction of the holding member 8, there are non-apertured portions Y besides the opposite end portions, the toner scraped off by the scraping wall member 7 becomes liable to accumulate in these portions. Accordingly, in order to prevent the accumulation of the toner, it is preferable to provide the collecting passage 9 so that there may be no non-apertured portions substantially over the entire area except the opposite end portions. Alternatively, it is desirable that in the longitudinal direction of the holding member 8, the width of the non-apertured portion Y be 1 mm or less.

However, the collecting passage 9 is not restricted in its shape and size unless the toner stripped off from the developing roller 4 accumulates on the holding member 8, and can be suitably set in other ways than what has been described above. For example, the holding member 8 may be made into a mesh shape to thereby provide the collecting passage 9. The holding member 8, if it can support the scraping wall member 7 and permits the provision of the collecting passage 9, is not restricted to the material used in the present embodiment.

(Operation of the Developing Apparatus)

Subsequently, the operation of this developing apparatus 1 will be described. In the present embodiment, the gap between the developing roller 4 and the supplying roller 5 is 1.0 mm and the peripheral speed of the supplying roller 4 is 74.4% of the peripheral speed of the developing roller 4. The toner is supplied from the toner containing portion 2*a* to the developing chamber 2*b* by the rotation of the agitating vane 3. This toner is then conveyed by the rotation of the supplying roller 5 in the direction indicated by the arrow B. The toner conveyed by the supplying roller 5 is intercepted by the scraping wall member 7. Then, this toner is urged against the developing roller 4 in the space, i.e., the toner supplying portion X, closed (surrounded) by the developing roller 4, the scraping wall member 7 and the supplying roller 5. As a result, the toner is supplied to the developing roller 4.

The toner carried on the outer peripheral surface of the developing roller 4 passes between the developing roller 4 and the developing blade 6 by the rotation of the developing roller 4 in the direction indicated by the arrow A. At this time, the toner on the developing roller 4 is made into a thin layer by the developing blade 6 and also, is frictionally charged. The toner on the developing roller 4 is further conveyed by the rotation of the developing roller 4 and is conveyed to the contact portion (developing area) between the developing roller 4 and the photosensitive drum 21. In the developing area, the toner on the developing roller 4 is supplied onto the photosensitive drum 21 in accordance with the electrostatic image thereon, by the action of a development bias applied to the developing roller 4. As a result, the electrostatic image on the photosensitive drum 21 becomes a toner image.

The residual toner on the developing roller 4 after the termination of the developing step (i.e., after the passage through the developing area) is stripped off from the developing roller 4 in the contact portion (stripping portion) C between the scraping wall member 7 and the developing roller 4, in accordance with the rotation of the developing roller 4 in the direction indicated by the arrow A. At this time, in the present embodiment, the scraping wall member 7 is formed of urethane foam, and the more compressed the scraping wall member 7 becomes, by the corner portion 7*a* (FIG. 2), the easier it becomes for the toner on the developing roller 4 to be stripped off. Then, the toner stripped off from the developing roller 4 passes through the collecting passage 9 provided in the holding member 8, and is conveyed by the rotation of the supplying roller 5 as indicated by broken-line arrow T2, and is conveyed in a direction away from the developing roller 4 and typically is returned to the toner containing portion 2*a*.

As described above, the toner mostly newly supplied from the toner containing portion 2*a* to the developing chamber 2*b* and conveyed by the supplying roller 5 is pushed into the toner supplying portion X. Therefore, even in a case where after being scraped off from the developing roller 4 by the scraping wall member 7, there is toner conveyed by the supplying roller 5 and not returned to the toner containing portion 2*a*, it is greatly suppressed for the toner to be immediately supplied onto the developing roller 4.

While in the present embodiment, the toner passes through the collecting passage 9 and falls and is directed into a range which the conveying action of the supplying roller 5 reaches, the present invention is not restricted thereto. The collecting passage can be provided so that the toner scraped off from the developing roller 4 may pass there through and be directed to the range which the conveying action of the supplying roller 5 reaches.

In the image forming apparatus 100 of the present embodiment, an image output endurance test of 1,000 sheets was carried out. As described above, in the developing apparatus 1 provided in the image forming apparatus 100 of the present embodiment, the residual toner on the developing roller 4 after the termination of the developing step is stripped off from the developing roller 4 and is collected in the toner containing portion 2*a*. That is, it is suppressed for the toner, scraped off from the developing roller 4, to be immediately supplied again to the developing roller 4 and used for development. Therefore, mechanical damage to the toner due to frictional contact or the like is small during the continuous use of the apparatus, and this is advantageous for the prevention of the deterioration of the toner. As the result, the fusion of the toner to the developing blade 6 was suppressed, and the streak-shaped irregularities of the toner did not occur on the developing roller 4. Therefore, a streak-shaped density difference did not occur to the image.

Also, a charge eliminating member is not used to strip off the residual toner on the developing roller 4 after the termination of the developing step and therefore, the separation of the extraneous additive from the toner due to electrical influence occurs to a small extent. Thus, it has become possible to prevent such image defects as a reduction in the triboelectricity of the toner due to the continuous use of the apparatus, and the occurrence of a ghost image due to an increase in the degree of aggregation.

Also, in the present embodiment, the scraping wall member 7 performing both of the function of supplying the toner to the developing roller 4 and the function of stripping off the toner from the developing roller 4 is made to abut against the developing roller 4 uniformly in the longitudinal direction thereof by the holding member 8 formed by film of polyethylene terephthalate. Therefore, a uniform image free of density unevenness could be obtained. Also, the toner stripped off by the scraping wall member 7 immediately passes through the collecting passage 9 and is returned to the toner containing portion 2*a* by the rotation of the supplying roller 5 and therefore, such an image defect as fog, caused by the accumulation of the toner, did not occur.

As described above, according to the present embodiment, the residual toner on the developing roller 4 after the termination of the developing step is stripped off by the scraping wall member 7 and immediately passes through the collecting passage 9, and typically is conveyed by the supplying roller 5 and is returned to the toner containing portion 2*a*. Therefore, the toner is suppressed from being continuously used and it becomes difficult for the deterioration of the toner to occur. That is, according to the present embodiment, unlike the conventional developing apparatus, it does not happen that the toner passes through the gap between the developing roller 4 and the seal member many times while adhering to the developing roller 4, and is subjected to frictional contact. Therefore, during the continuous use of the apparatus, the streak-shaped density difference due to the fusion of the toner to the developing blade 6 can be suppressed. Also, in order to remove the toner from the developing roller 4, a charge eliminating member is unnecessary, and the separation of the extraneous additive from the toner occurring due to electrical influence can also be suppressed. This is advantageous for the prevention of image defects, such as a reduction in the triboelectricity of the toner due to the continuous use of the apparatus and the occurrence of a ghost image due to an increase in the degree of aggregation. That is, according to the present embodiment, image problems due to the deterioration of the toner can be suppressed.

Also, in the present embodiment, the scraping wall member 7 is held by the plate-shaped holding member 8, whereby the scraping wall member 7 can be made to abut against the developing roller 4 uniformly in the longitudinal direction thereof. The collecting passage 9, which is an aperture extending through the holding member 8, is provided just beside the scraping wall member 7 installed on the plate-shaped holding member 8 and therefore, the toner stripped off from the developing roller 4 by the scraping wall member 7 immediately passes through the collecting passage 9. Accordingly, the accumulation of the toner on the upstream side of the scraping portion C with respect to the surface movement direction of the developing roller 4 can be prevented. Further, the collecting passage 9 is provided so that in the longitudinal direction of the holding member 8, there may be no non-apertured portions substantially over the entire area except the opposite end portion, whereby it can be prevented for the toner stripped off from the developing roller 4 to be incapable of passing through the collecting passage 9, thereby causing the accumulation of the toner on the upstream side of the scraping portion C with respect to the surface movement direction of the developing roller 4. Accordingly, an image defect such as fog caused by the accumulation of the toner can be prevented.

Embodiment 2

Another embodiment of the present invention will now be described. The basic constructions and operations of a developing apparatus and an image forming apparatus according to the present embodiment are the same as those of Embodiment 1. Accordingly, elements substantially identical with or corresponding to those in Embodiment 1 in function and construction are given the same reference characters and need not be described in detail.

Figure 6:
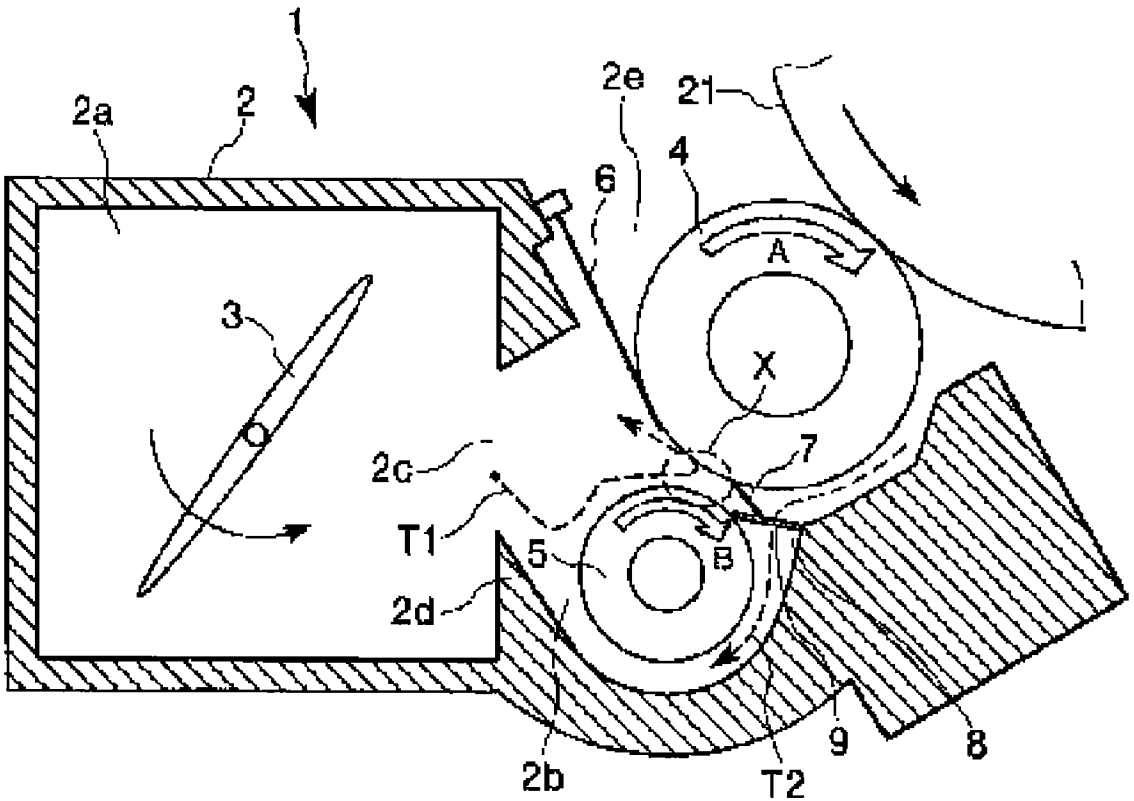
FIG. 6 is a schematic cross-sectional view of another embodiment of the developing apparatus according to the present invention.
Figure 7:
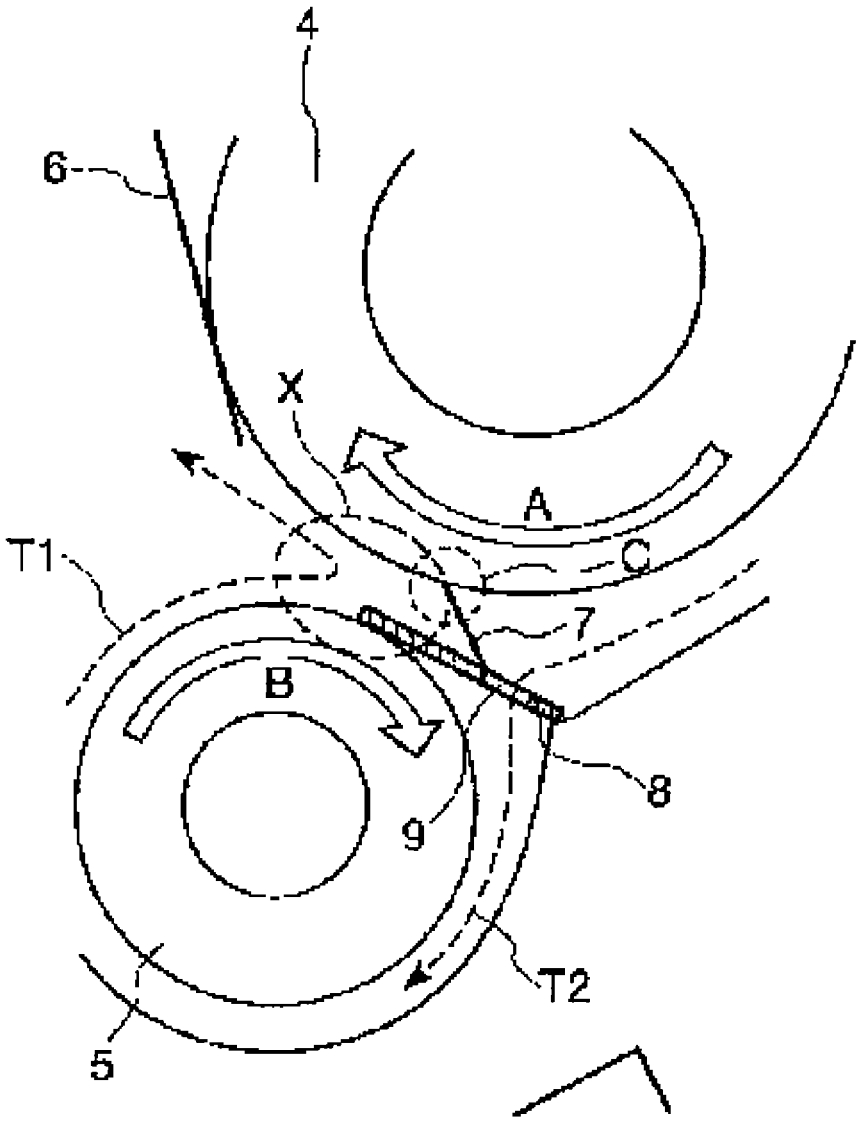
FIG. 7 is an enlarged cross-sectional view of the vicinity of a toner supplying and scraping portion in the developing apparatus of FIG. 6.

As shown in FIGS. 6 and 7, in the present embodiment, the material of the scraping wall member 7 differs from that in Embodiment 1. In other respects, the constructions and operations of the developing apparatus 1 and the image forming apparatus 100 are substantially the same as those in Embodiment 1.

In the present embodiment, the material of the scraping wall member 7 was changed from urethane foam to resin film as an elastic member. Further describing the present embodiment, instead of the urethane foam used in Embodiment 1, a film of polyethylene terephthalate having a thickness of 100 μm is used as the scraping wall member 7. The scraping wall member 7 formed by this film of polyethylene terephthalate is mounted on a holding member 8 similar to that in Embodiment 1. In the present embodiment, the scraping wall member 7 has its free end turned toward the downstream side with respect to the surface movement direction of the developing roller 4 and abuts against the developing roller 4 in that end portion.

The scraping wall member 7, which is film of polyethylene terephthalate, contacts the developing roller 4, whereby the gap between the supplying roller 5 and the developing roller 4 is closed to thereby form a toner supplying portion X. As a result, such a flow of toner as indicated by broken-line arrow T1 in FIG. 6 is formed. That is, as in Embodiment 1, the toner supplied from the toner containing portion 2*a* to the developing chamber 2*b* by the rotation of the agitating vane 3 is conveyed toward the toner supplying portion X by the rotation of the supplying roller 5. Then, the toner conveyed to the toner supplying portion X is conveyed toward the contact portion between the developing blade 6 and the developing roller 4 by the rotation of the developing roller 4.

Also, the residual toner on the developing roller 4 after the termination of the developing step is stripped off from the developing roller 4 in the contact portion (scraping portion) C between the scraping wall member 7 and the developing roller 4. Then, the toner stripped off from the developing roller 4 passes through the collecting passage 9 provided in the holding member 8, and is conveyed by the rotation of the supplying roller 5 as indicated by broken-line arrow T2, and typically is returned to the toner containing portion 2*a*.

In a case where the scraping wall member 7 is formed by the film of polyethylene terephthalate, the abutting pressure thereof against the developing roller is easy to heighten, as compared with a case where it is formed of urethane foam in Embodiment 1. That is, by the scraping wall member 7 being formed by the film of polyethylene terephthalate, the hermetically sealed property of the toner supplying portion X is increased and the force with which the toner is urged against the developing roller 4 is increased. Therefore, the more effective supply of the toner to the developing roller 4 becomes possible.

As described above, according to the present embodiment, the force with which the toner is urged against the developing roller 4 is higher than in Embodiment 1 and therefore, an image of high density can be outputted. Also, the scraping wall member 7 itself can be made thinner than in a case where the scraping wall member 7 is formed of polyurethane foam and therefore, as compared with Embodiment 1, it becomes easy to achieve the downsizing of the construction of the upstream side of the scraping portion C with respect to the surface movement direction of the developing roller 4.

While in the present embodiment, the film of polyethylene terephthalate having a thickness of 100 μm is used as the scraping wall member 7, uses may be made of thicker resin film (such as film of polyethylene terephthalate). In this case, it becomes easy to increase the abutting pressure of the scraping wall member 7 against the developing roller 4 and therefore, it becomes easy to further enhance the hermetically sealed property of the toner supplying portion X, and more strongly urge the toner against the developing roller 4. As a result, it becomes easy to output an image of higher density, and it also becomes easy to enhance the stripping-off property of the toner on the developing roller 4.

As described above, according to the present embodiment, the material of the scraping wall member is changed from urethane foam to film of polyethylene terephthalate, whereby the scraping wall member 7 can be made higher in the hermetically sealing property. Therefore, in the space, i.e., the toner supplying portion X, surrounded by the scraping wall member 7, the developing roller 4 and the supplying roller 5, the force with which the toner is urged against the developing roller 4 increases, and an image high in density up to the rear end portion of the formed image can be obtained.

Embodiment 3

Still another embodiment of the present invention will now be described. The basic constructions and operations of a developing apparatus and an image forming apparatus according to the present embodiment are the same as those of Embodiment 1. Accordingly, elements substantially identical with or corresponding to those in Embodiment 1 in function and construction are given the same reference characters and need not be described in detail.

Figure 8:
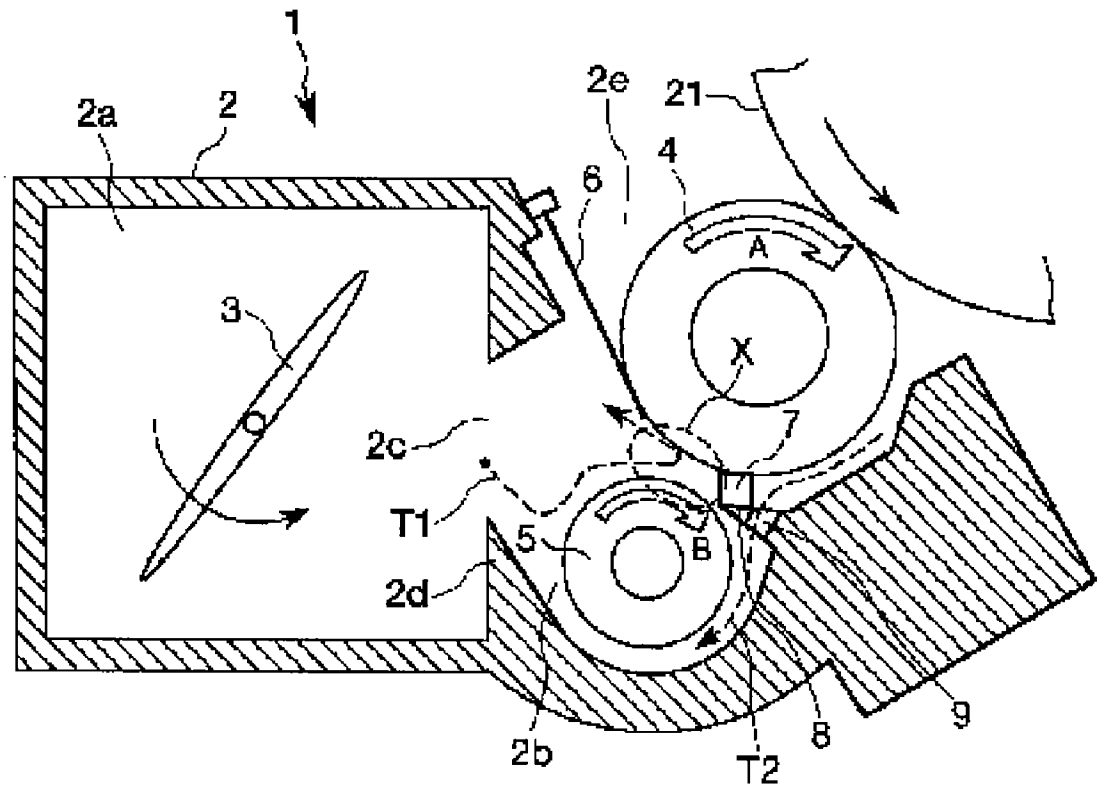
FIG. 8 is a schematic cross-sectional view of still another embodiment of the developing apparatus according to the present invention.
Figure 9:
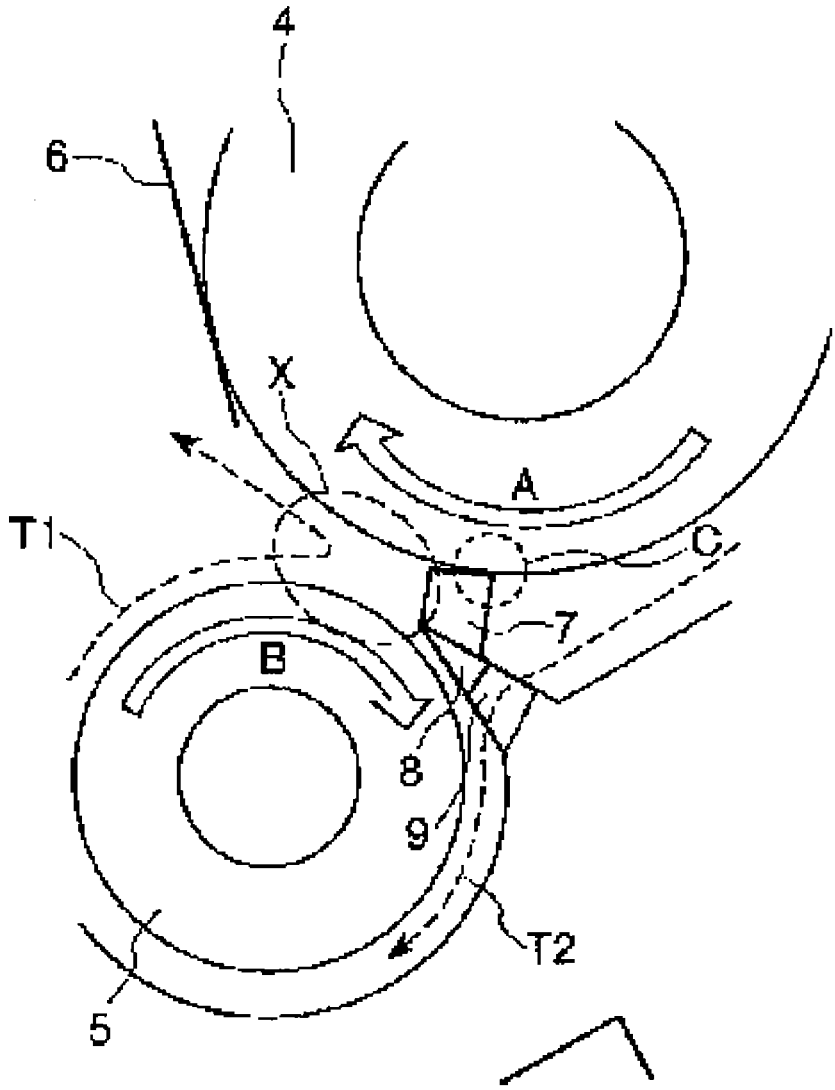
FIG. 9 is an enlarged cross-sectional view of the vicinity of a toner supplying and scraping portion in the developing apparatus of FIG. 8.

As shown in FIGS. 8 and 9, in the present embodiment, the holding member 8 for holding the scraping wall member 7 differs from that in Embodiment 1. In other respects, the constructions and operations of the developing apparatus 1 and the image forming apparatus 100 are substantially the same as those in Embodiment 1.

In the present embodiment, instead of the film of polyethylene terephthalate in Embodiment 1, the frame (the developer container frame, i.e., container) 2 itself of at least a portion prescribing the internal volume of the developing apparatus 1 is given a function as the holding member 8 for holding the scraping wall member 7, and the collecting passage 9 is also provided in the container 2 itself.

Further describing the present embodiment, the scraping wall member 7 is mounted on a projected portion 8 formed integrally with the container 2 as the holding member. That is, in the present embodiment, as shown in FIG. 9, the shape of the container 2 upstream of the closest position between the developing roller 4 and the supplying roller 5 with respect to the surface movement direction of the developing roller 4 is made into such a projection shape that the distal end in a direction crossing the axial direction of the developing roller 4 is proximate to the supplying roller 5. As a result, the inner wall of the container 2 is made into a shape in which the scraping wall member 7 is supported as a holding member and also, the collecting passage 9 can be provided. In the present embodiment, the distal end of the projected portion 8 is proximate to the supplying roller 5 with a gap of 200 μm-500 μm interposed therebetween. This gap is provided to such a degree that sufficient toner pressure in the toner supplying portion X can be secured. Near the distal end of this projected portion 8, there is installed the scraping wall member 7 formed of open-cell polyurethane foam having a width of 3 mm and a height of 3 mm, as in Embodiment 1. There is formed a space, i.e., a toner supplying portion X, surrounded by the developing roller 4, the scraping wall member 7 and the supplying roller 5. The scraping wall member 7 may be such film of polyethylene terephthalate as shown in Embodiment 2.

Figure 10:
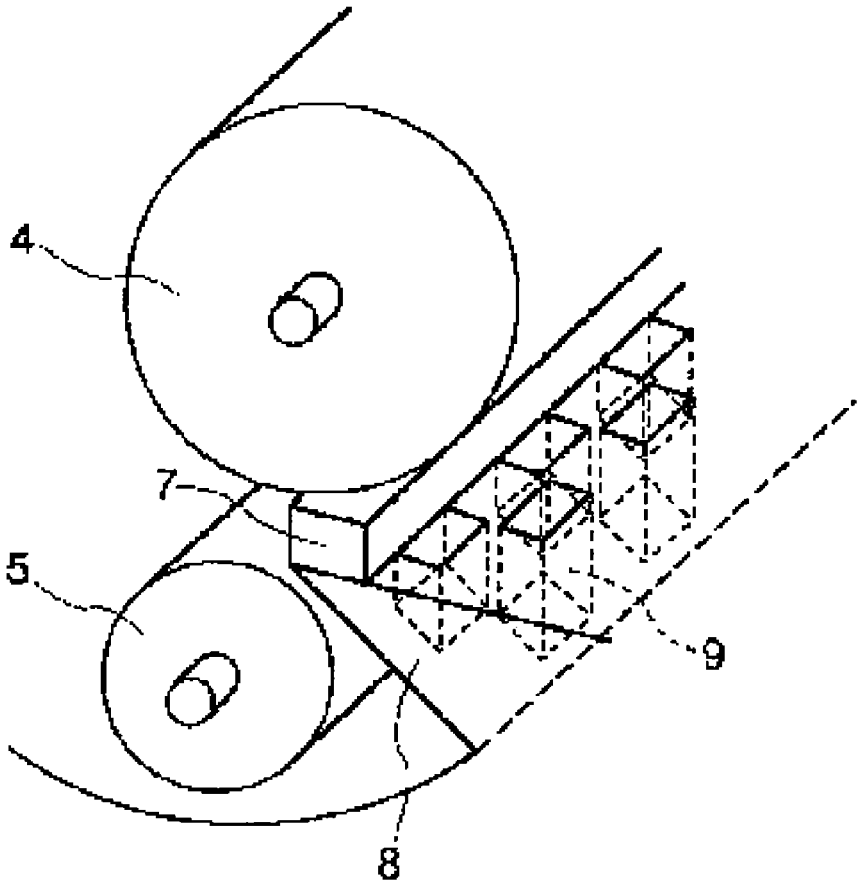
FIG. 10 is a schematic perspective view for illustrating the construction of a collecting passage in the developing apparatus of FIG. 8.
Figure 11:
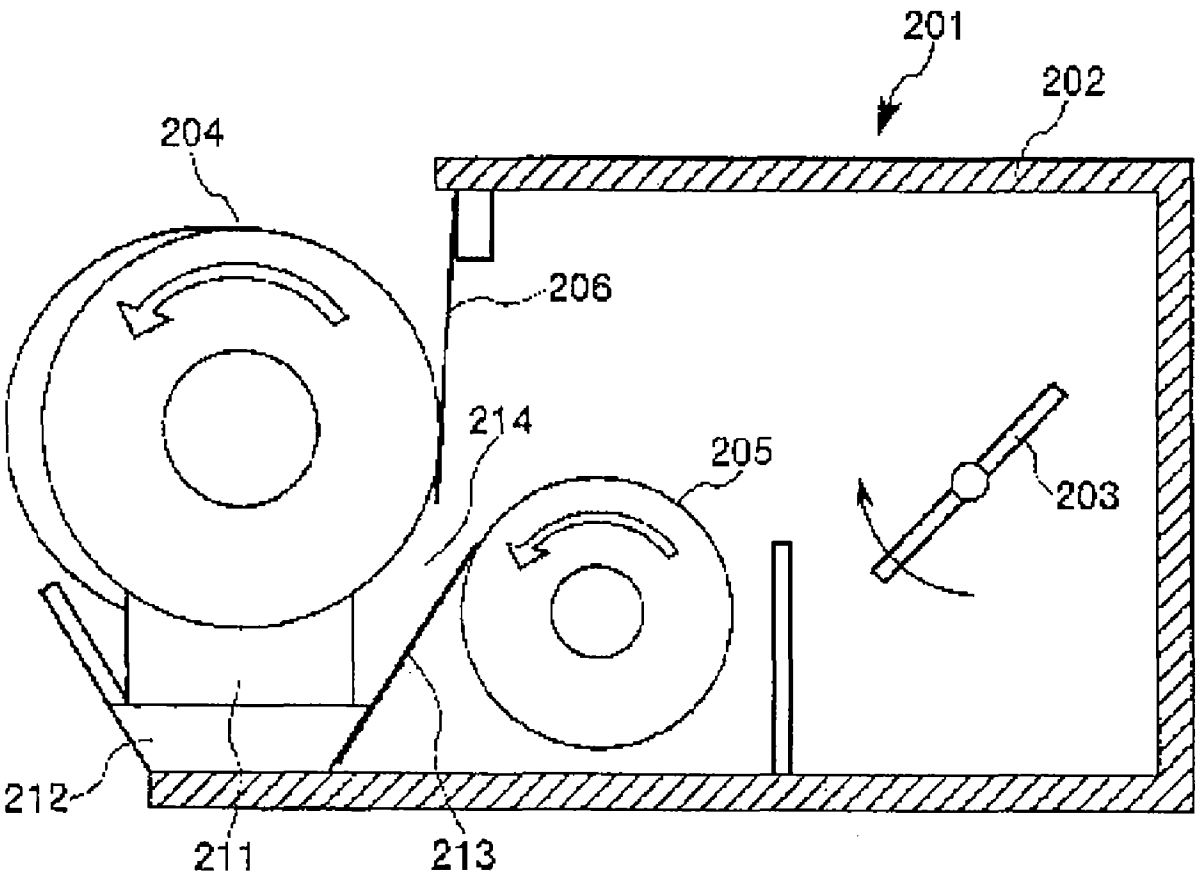
FIG. 11 is a schematic cross-sectional view of an example of a conventional developing apparatus.

Also, in the present embodiment, the collecting passage 9 is provided in the projected portion 8 integral with the container 2. FIG. 10 is an enlarged view of the collecting passage 9 provided in the projected portion 8. The projected passage 9 is constituted by an aperture extending through the projected portion 8. Also, the collecting passage 9, as in Embodiment 1, is provided so that in the direction along the axial direction of the developing roller 4, there may be no non-apertured portions substantially over the entire area except the opposite end portions. As a result, the accumulation of the toner on the upstream side of the scraping portion C with respect to the surface movement direction of the developing roller 4 can be prevented.

In the present embodiment, the film of polyethylene terephthalate for holding the scraping wall member 7 becomes unnecessary. Therefore, the assembly of the developing apparatus 1 becomes simple and the number of parts can be decreased, and this is advantageous also in terms of cost. Also, in Embodiment 1 and Embodiment 2, the supplying roller 5 and the holding member 8 formed by the film of polyethylene terephthalate contact each other. In contrast, in the present embodiment, the supplying roller 5 is out of contact with the projected portion 8 of the container 2, which functions as the holding member. Therefore, in the present embodiment, as compared with Embodiment 1 and Embodiment 2, the torque for rotating the supplying roller 5 becomes small.

As described above, according to the present embodiment, the scraping wall member 7 is installed on the container 2 itself, whereby in order to support the scraping wall member 7, a discrete member such as the plate-shaped holding member used, for example, in Embodiment 1 becomes unnecessary. Therefore, the assembly of the developing apparatus 1 becomes simple. Also, the number of parts is decreased, and this is advantageous also in cost. The holding member 8 formed integrally with the container 2 itself is proximate to, but is not in contact with the supplying roller 5, and this leads to the advantage that the torque for rotating the supplying roller 5 becomes small.

While the present invention has been described above with respect to the specific embodiments thereof, it should be understood that the present invention is not restricted to the above-described embodiments.

Also, in a case where for example, the scraping wall member 7 and the holding member 8 are both formed by film of polyethylene terephthalate, the scraping wall member 7 and the holding member 8 may be formed integrally with each other.

Also, in the above-described Embodiment 3, the distal end of the projected portion 8 formed integrally with the container 2 as the holding member for the scraping wall member 7 is out of contact with the supplying roller 5, but may be in contact with the supplying roller 5.

Also, a seal member, for example, resin film may be provided, for example, on the distal end of the projected portion 8, and may be brought into contact with the supplying roller 5. As a result, as in Embodiment 1, the downstream side of the toner supplying portion X with respect to the surface movement direction of the supplying roller 5 is substantially hermetically sealed. Alternatively, the scraping wall member 7 itself may contact with both of the developing roller 4 and the supplying roller 5 so as to substantially hermetically seal the downstream side of the toner supplying portion X with respect to the surface movement direction of the supplying roller.

According to Embodiments 1 to 3 described above, image problems due to the deterioration of the developer can be suppressed. Also, as one of operational effects which can be achieved by the present invention, it can be mentioned that the residual developer on the developer carrying member after the passage through the developing area can be suppressed from being immediately supplied again onto the developer carrying member.

Another embodiment of the developing apparatus of the present invention will now be shown.

Embodiment 4

Image Forming Apparatus

Figure 14:
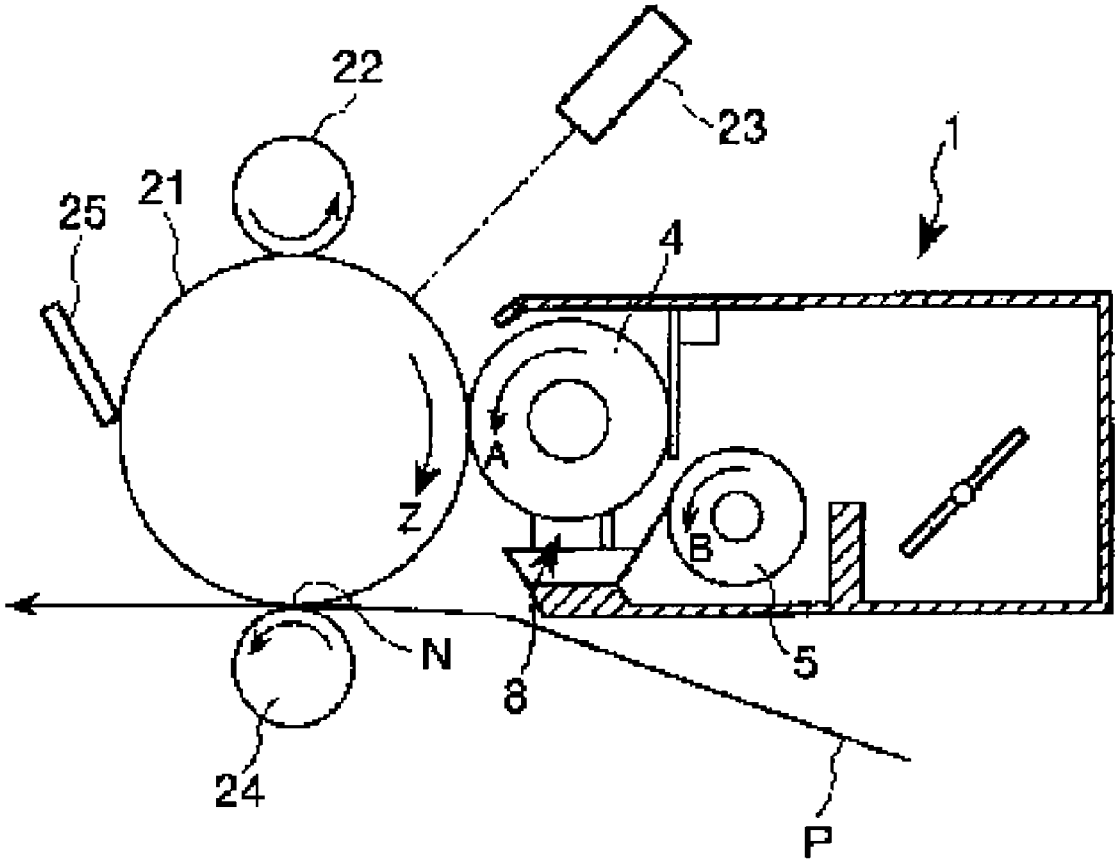
FIG. 14 is a view schematically showing the construction of the essential portions of an embodiment of the image forming apparatus according to the present invention.

Reference is first had to FIG. 14 to describe the general construction and operation of an image forming apparatus provided with a developing apparatus constructed in accordance with the present invention. In the present embodiment, the image forming apparatus 100 is a laser beam printer which forms an image on a transfer material (such as recording paper, an OHP sheet or cloth) by the utilization of an electrophotographic printing method in accordance with an image information signal from a personal computer, an image reading apparatus or the like communicably connected to an image forming apparatus main body (apparatus main body), and outputs it. Also, the image forming apparatus 100 according to the present embodiment is provided with a developing apparatus 1 using a nonmagnetic mono-component developer (toner).

The image forming apparatus 100 has drum-shaped photosensitive member, i.e., a photosensitive drum 21, as an image bearing member. The photosensitive drum 21 is rotatably driven in the direction indicated by the arrow Z. The surface of the rotated photosensitive drum 21 is charged to a predetermined polarity (a negative polarity in the present embodiment) and potential by a charging roller 22 as charging means. The charged surface of the photosensitive drum 21 is scanned and exposed in accordance with the image information signal by a laser scanner 23 as exposing means (image writing-in means). As a result, an electrostatic image is formed on the photosensitive drum 21. The electrostatic image formed on the photosensitive drum 21 is then supplied with the toner of the developer by the developing apparatus 1, and is visualized as a visible image, i.e., a toner image.

On the other hand, in timed relationship with the formation of the toner image on the photosensitive drum 21, a transfer material P is conveyed from a transfer material supplying portion, not shown, to a transferring portion N in which the photosensitive drum 21 and a transfer roller 24 as transferring means are opposed to each other. Then, the toner image on the photosensitive drum 21 is transferred onto the transfer material P by the action of the transfer roller 24. At this time, a bias of a polarity opposite to the regular charging polarity (the negative polarity in the present embodiment) of the toner is applied from transfer bias outputting means, not shown, to the transfer roller 24.

The transfer material P to which the toner image has been transferred is thereafter conveyed to a fixing device, not shown, as fixing means. The toner on the transfer material P is heated and pressurized by the fixing device, and is thereby fixed on the transfer material P. Thereafter, the transfer material P is discharged out of the apparatus main body.

Also, any residual toner on the photosensitive drum 21 after the transfer of the toner image is removed by a cleaning blade 25 as cleaning means, and is collected in a waste toner container, not shown.

[Developing Apparatus]

Figure 12:
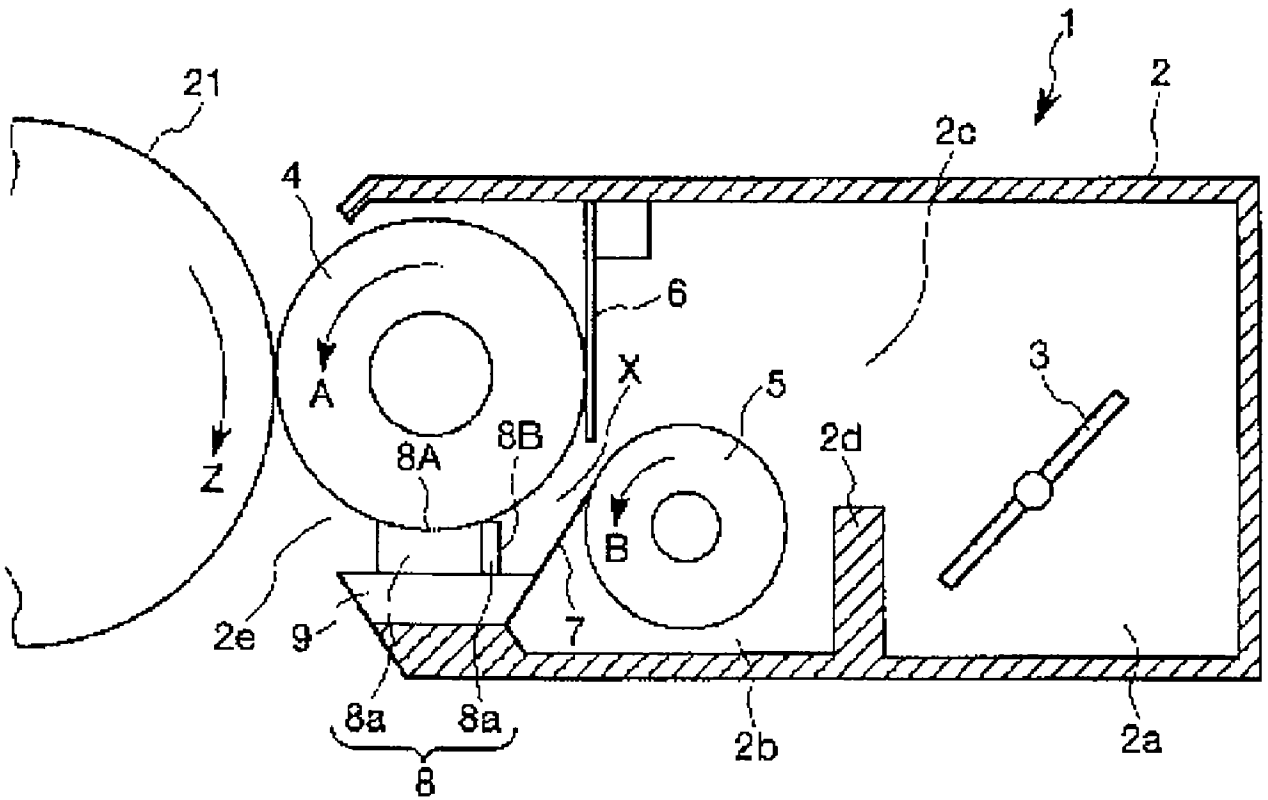
FIG. 12 is a schematic cross-sectional view of an embodiment of the developing apparatus according to the present invention.

FIG. 12 shows a schematic cross-sectional view of the developing apparatus 1 in the present embodiment. In the present embodiment, the developing apparatus 1 uses a nonmagnetic mono-component developer, i.e., a toner, as a developer. The developing apparatus 1 has a container (developer container frame)$_2$. The container 2 has a toner containing portion 2*a* in which the toner is contained, and a developing chamber 2*b* in which developing means such as a developer carrying member which will be described later is disposed. An agitating vane 3 as a developer agitating and conveying member is disposed in the toner containing portion 2*a*. By the rotation of this toner conveying member 3, the toner in the toner containing portion 2*a* is supplied to the developing chamber 2*b*. The toner containing portion 2*a* and the developing chamber 2*b* communicate with each other by a toner conveying opening portion 2*c* and also, are partitioned by a partition wall 2*d* formed so as to protrude upwardly from the bottom surface of the container 2. As a result, a desired amount of toner can be held in the developing chamber 2*b*.

The developing chamber 2*b* of the container 2 partly opens at a portion thereof opposed to the photosensitive drum 21, and a developing roller 4 as a developer carrying member is disposed so as to be partly exposed from the opening portion 22. The developing roller 4 is rotatably supported by the container 2. The developing roller 4 is disposed in contact with the photosensitive drum 21. The photosensitive drum 21 is rotatable in the direction indicated by the arrow Z, whereas the developing roller 4 is rotatable in the direction indicated by the arrow A. That is, the developing roller 4 and the photosensitive drum 21 are rotated so that in the contact portion therebetween, the movement directions of the surfaces (outer peripheral portions) thereof may be a forward direction.

Further, in the developing chamber 2*b*, around the developing roller 4, there are disposed a supplying roller 5 as a developer supplying member, a developing blade 6 as a developer regulating member, a scraping member 7 and a seal member 8 which is an elastic member contacting with the developing roller 4.

The seal member 8 is supported by a holding member 9 provided on the bottom portion of the container 2 at one edge portion of the opening portion 2*e* of the container 2, and is disposed in contact with the developing roller 4. That is, the seal member 8 is disposed in contact with the developing roller 4 downstream of a developing area for supplying the toner from the developing roller 4 to the photosensitive drum 21 and upstream of the closest position between the developing roller 4 and the supplying roller 5, with respect to the surface movement direction of the developing roller 4. The supplying roller 5 is disposed out of contact with and in opposed relationship with the developing roller 4 downstream of the seal member 8 (namely, downstream of the developing area) and upstream of the contact portion between the developing roller 4 and the developing blade 6, with respect to the surface movement direction of the developing roller 4. The supplying roller 6 is rotatably supported by the container 2. The supplying roller 5 is rotatable in the direction indicated by the arrow B. That is, the developing roller 4 and the supplying roller 5 are rotated so that in the opposed portion therebetween, the movement directions of the surfaces (outer peripheral portions) thereof may be opposite directions. The scraping member 7 is mounted on the end surface of the holding member 9 adjacent to the internal side of the container 2, and is disposed in contact with the supplying roller 5. The developing blade 6 is disposed in contact with the developing roller 4 downstream of the closest position between the developing roller 4 and the supplying roller 5 (namely, downstream of the seal member 8) with respect to the surface movement direction of the developing roller.

The supply of the toner to the developing roller 4 is effected in the following manner. The toner in the toner containing portion 2 is conveyed to the developing chamber 2*b* by the agitating vane 3. The toner conveyed to the developing chamber 2*b* is conveyed to the vicinity of the developing roller 4 by the rotation of the supplying roller 5. This toner conveyed by the supplying roller 5 is scraped off from the supplying roller 5 by the scraping member 7. The toner thus scraped off from the supplying roller 5 is supplied to the developing roller 4.

By such a construction, in the developing apparatus 1 of the present embodiment, a space (containing portion) surrounded by the developing roller 4, the seal member 8, the scraping member 7, the supplying roller 5 and further, the scraping member 7 constitutes a toner supplying portion (developer supplying portion) X for holding the toner between the developing roller 4 and the supplying roller 5. In this toner supplying portion X, the toner conveyed to the portion opposed to the developing roller 4 by the rotation of the supplying roller 5 is urged against the developing roller 4 so that the toner may be supplied onto the developing roller.

Here, in the conventional developing apparatus, the supplying capability of the supplying roller was increased to thereby obtain the desired image density. In the present embodiment, it is an object to obtain the desired image density without increasing the supplying capability of the supplying roller. A description thereof will hereinafter be provided in greater detail.

(Developer Carrying Member)

The developing roller 4 as a developer carrying member carries the toner thereon and conveys it to the photosensitive drum 21. The developing roller 4 is disposed in contact with the photosensitive drum 21, and is rotated in the direction indicated by the arrow A. In the present embodiment, the developing roller 4 is an elastic roller comprising a cylindrical solid metal bar (mandrel) having an outer diameter of 8 mm, and an elastic layer laminated to about 4 mm on the outer periphery thereof, so that the elastic roller may have an outer diameter of 16 mm. As the elastic layer, use can be made of popular rubber such as silicone rubber, urethane rubber, epichlorohydrin rubber, nitrile butadiene rubber or ethylene propylene diene rubber (EPDM).

As regards the developing roller 4, the elastic layer itself may be the outermost layer, but with the chargeability given to the toner taken into account, the surface layer may be formed of a material differing from that of the elastic layer. When a toner of negative chargeability is used, urethane resin, polyamide resin, silicone resin or the like is usable as the surface layer. Also, when a toner of positive chargeability is used, fluorine resin or the like is usable as the surface layer. In the present embodiment as the developing roller 4, use is made of a roller comprising an elastic layer formed of silicone rubber coated with urethane resin to about 20 μm as the surface layer.

The surface roughness of the developing roller 4 should preferably be 2-8 μm in terms of ten-point mean roughness Rz (JIS B 0601). If the surface roughness Rz is less than 2 μm, the toner amount which can be carried on the developing roller 4 will decrease and there is the possibility that desired density may become unobtainable. Also, if the surface roughness Rz exceeds 8 μm, the toner amount carried on the developing roller 4 is liable to become partly non-uniform, and this may lead to uneven density when printing is done. For the measurement of the surface roughness, use was made of a surface roughness test machine "SE-30H" produced by Kosaka Laboratory Ltd.

Also, the electrical resistance value of the developing roller 4 should preferably be within a range of $1.0\times10^3$–$2.0\times10^7\Omega$. If the electrical resistance value of the developing roller 4 is less than $1.0\times10^3\Omega$, a voltage will become liable to leak. If the electrical resistance value of the developing roller 4 exceeds $2.0\times10^7\Omega$, the uneven density of an image will become liable to occur. In the present embodiment, use was made of a developing roller 4 having an electrical resistance value of $4.5\times10^4\Omega$. The electrical resistance value of the developing roller 4 was measured in the following manner. The electrical resistance value of the developing roller 4 was calculated from the current value when a stainless steel cylinder member having an outer diameter of 30 mm and the developing roller 4 were brought into contact with each other and opposed relationship with each other, and a DC voltage of 100 V was applied to between the mandrel of the developing roller 4 and the stainless steel cylinder member.

Also, development bias outputting means is connected to the developing roller 4. During the developing operation, by the action of an electric field by a development bias applied from this development bias outputting means to the developing roller 4, the toner on the developing roller 4 is supplied onto the photosensitive drum 21 in accordance with the electrostatic image thereon. In the present embodiment, the toner charged to the same polarity (the negative polarity in the present embodiment) as the charging polarity of the photosensitive drum 21 is made to adhere to a portion (light portion) on the photosensitive drum 21 in which the charges have been attenuated by exposure.

(Developer Regulating Member)

The developing blade 6 as a developer regulating member regulates the toner amount coating the developing roller 4. In the present embodiment, the developing blade 6 is formed by a thin metal plate which is a plate-shaped resilient member. The developing blade 6 is brought into contact with the developing roller 4 with predetermined abutting pressure, by the utilization of the spring resiliency of the thin metal plate. As the material of the thin metal plate, use can be made of stainless steel, phosphor bronze or the like. In the present embodiment, a thin phosphor bronze plate having a thickness of 0.1 mm was used as the developing blade 6.

(Developer Supplying Member)

The supplying roller 5 as a developer supplying member conveys the toner to the developing roller 4. The supplying roller 5 is disposed in non-contact with and in opposed relationship with the developing roller 4, and is rotated in the direction indicated by the arrow B. The developing roller 4 and the supplying roller 5 are rotated so that in the opposed portion therebetween, the surface movement directions thereof may be opposite directions.

In the present embodiment, as the supplying roller 5, use was made of an aluminum bar having an outer diameter of 10 mm and surface roughness Rz 3.0 μm. The supplying roller 5 is adapted to be capable of supplying the toner over a range equal to or greater than the developing area in the axial direction (a direction crossing the surface movement direction) of the developing roller 4.

The supplying roller 5, if it can convey the toner to the toner supplying portion X, is not particularly limited in its material and shape. However, the surface roughness Rz thereof should preferably be 1 μm-10 μm. If the surface roughness Rz is less than 1 μm, the toner conveyance amount will become liable to become small. Also, if the surface roughness Rz exceeds 10 μm, unevenness will become liable to occur to conveyance.

The peripheral speed (surface movement speed) of the supplying roller 5 should preferably be 60-200% of the peripheral speed of the developing roller 4. If this peripheral speed ratio is less than 60%, a desired amount of toner will become incapable of being conveyed, and there is the possibility of producing an image of low density. If this peripheral speed ratio exceeds 200%, the mechanical load will increase, and there is the possibility that the driving portion of the apparatus becoming bulky. In the present embodiment, the peripheral speed of the developing roller 4 was 120 mm/sec., and the peripheral speed of the supplying roller 5 was 84 mm/sec. (70% of the peripheral speed of the developing roller 4).

(Scraping Member)

The plate-shaped scraping member 7 has the role of scraping off the toner conveyed by the supplying roller 5 from the supplying roller 5, and containing it in the toner supplying portion X. In the present embodiment, as the scraping member 7, use was made of film of polyethylene terephthalate having a thickness of 100 μm which is a plate-shaped elastic member. The scraping member 7 has its free end turned toward the upstream side with respect to the surface movement direction of the supplying roller 5, and abuts against the supplying roller 5 by that end portion. The scraping member 7 has its other end supported by a holding member 9 provided in the container 2 at one edge portion of the opening portion 2*e* of the container 2. The scraping member 7, in a state installed in the developing apparatus 1, has a length extending substantially parallel to the axial direction of the supplying roller 5 and substantially over the entire toner carrying area on the supplying roller 5.

(Seal Member)

The seal member 8 has a seal portion (first member) 8*a* occupying the main portion of the seal member 8 and chiefly effecting the sealing of the toner and a wall portion (second member) 8*b* disposed more adjacent to the toner supplying portion X than this seal portion 8*a*, namely, on the downstream side with respect to the surface movement direction of the developing roller 4. The seal member 8 is mounted on the holding member 9 provided in the container 2 at one edge portion of the opening portion 2*e* of the container 8.

In the present embodiment, a foamed elastic member (hereinafter referred to also as the "sponge") is used as the seal portion 8*a* and the wall portion 8*b*. More specifically, in the present embodiment, as the seal portion 8*a*, use is made of open-cell polyurethane foam of a rectangular cross-sectional shape having a width (width in a direction orthogonal to the axial direction of the developing roller 4 when installed in the developing apparatus 1) of 5 mm, and a height (height in the direction of the gap between the developing roller 4 and the holding member 9 when installed in the developing apparatus 1) of 3 mm. Also, in the present embodiment, as the wall portion 8*b*, use is made of open-cell polyurethane foam of a rectangular cross-sectional shape having a width of 1 mm and a height of 3 mm. The seal portion 8*a* and wall portion 8*b* of the seal member 8, in a state installed in the developing apparatus 1, have a length extending substantially parallel to the axial direction of the developing roller 4 and substantially over the entire toner carrying area on the developing roller 4.

The seal portion 8*a* and the wall portion 8*b* are adhesively secured to each other, and are disposed so that the wall portion 8*b* may face the toner supplying portion X side. That is, the seal portion 8*a* is disposed on the upstream side in a direction along the surface movement direction of the developing roller 4, and the wall portion 8*b* is disposed downstream of the seal portion 8*a* with respect to the same direction.

In the present embodiment, the rubber hardness of the wall portion 8*b* is set higher than that of the seal portion 8*a*. As a result, the rubber hardness of that surface 8B of the seal member 8 which is adjacent to the toner supplying portion X (a second portion: hereinafter referred to also as the "toner supplying surface") is made higher than the rubber hardness of that surface 8A of the seal member 8 which contacts with the developing roller 4 (a first portion: hereinafter referred to also as the "seal surface").

Figure 13:
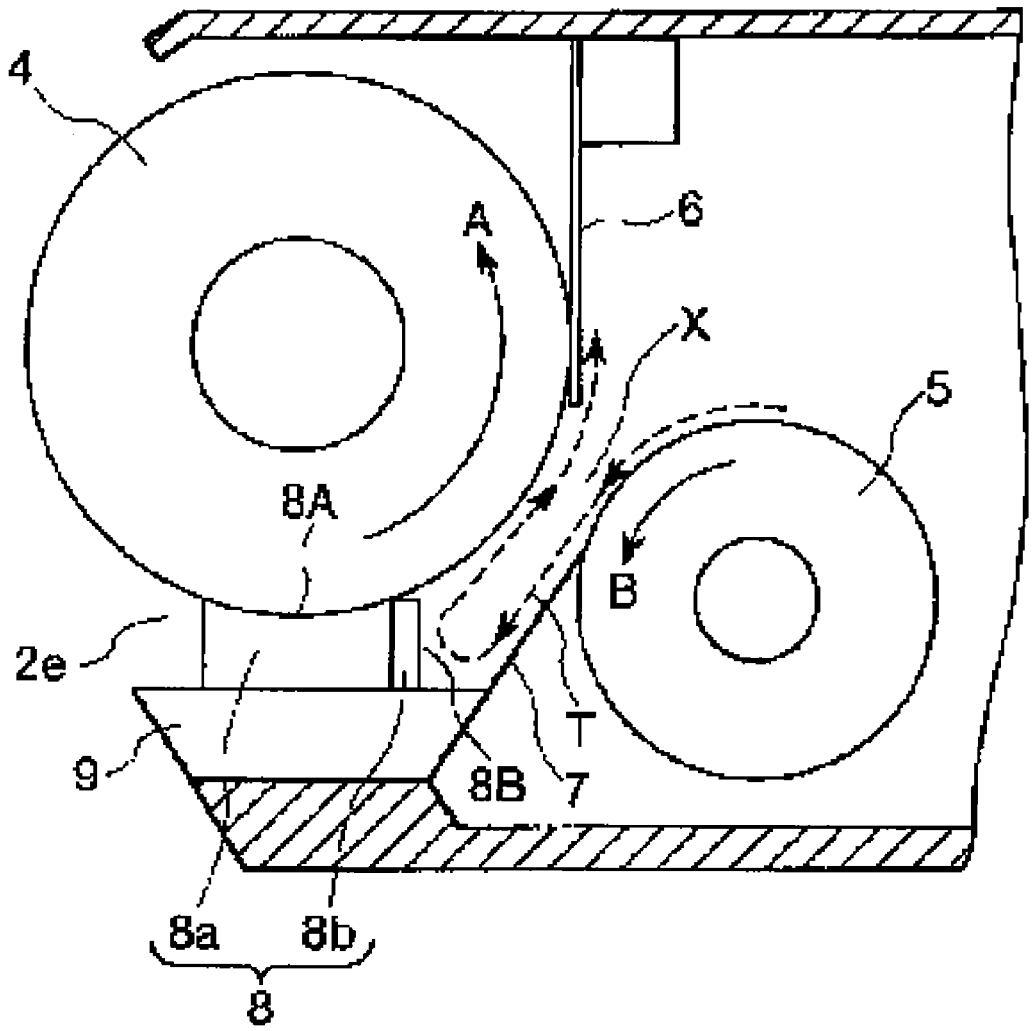
FIG. 13 is an enlarged cross-sectional view of the vicinity of a toner supplying portion in the developing apparatus of FIG. 1.

That is, as shown in FIG. 13, in the toner supplying portion X formed by the scraping member 7, the supplying roller 5, the wall portion 8*b* of the seal member 8, and the developing roller 4, there is formed a flow path T of the toner indicated by broken-line arrow. At this time, the toner conveyed by the supplying roller 5 is pushed into the toner supplying portion X. The toner pushed into the toner supplying portion X is urged against the developing roller 4, whereby the toner is supplied to the developing roller 4.

Therefore, the seal member 8 is required to pass the toner between the surface thereof and the developing roller 4 to return the toner on the developing roller 4 after the termination of the developing step into the developing chamber 2*b* and at the same time, heighten the toner pressure in the toner supplying portion X to supply the toner to the developing roller 4.

Accordingly, it is desirable that the rubber hardness of that surface of the seal member 8 which is adjacent to the toner supplying portion X be high. That is, the toner is supplied to the developing roller 4 by the high rubber hardness of this surface without losing the toner pressure in the toner supplying portion X. However, to collect the toner which has not contributed to development but is residual toner on the developing roller 4 into the developing chamber 2*b*, the rubber hardness of that surface of the seal member 8 which contacts with the developing roller 4 cannot be made high. This is because when the rubber hardness of this surface is made high, the residual toner on the developing roller 4 is scraped by the sponge of the seal member 8, and the toner on the developing roller 4 after the termination of the developing step cannot enter the toner supplying portion X.

So, in the present embodiment, the seal member 8 is constituted by a seal portion 8*a* and a wall portion 8*b* formed of sponges differing in rubber hardness from each other, and the rubber hardness of the surface (toner supplying surface) 8B which is adjacent to the toner supplying portion X is made higher than the rubber hardness of the surface (seal surface) 8A which contacts with the developing roller 4. As a result, it becomes possible to make the collection of the toner on the developing roller 4 after the termination of the developing step and the high toner pressure in the toner supplying portion X for the toner supply to the developing roller 4 compatible.

As the result, the toner pressure in the toner supplying portion X can be increased and therefore, it becomes possible to obtain the desired image density without making the peripheral speed of the supplying roller 5 higher than necessary.

Herein, the rubber hardness is shown as JIS-A hardness, and was measured by MD-1 hardness tester (A type) produced by Kobunshi Keiki Co., Ltd. In the present embodiment, the rubber hardness of the seal portion 8*a* of the seal member 8 and the rubber hardness of the wall portion 8*b* thereof were 40 degrees and 72 degrees, respectively. It is preferable that the rubber hardness of the seal portion 8*a*, and more particularly the seal surface 8A, be 15-55 degrees. If the rubber hardness of the seal portion 8*a* is less than 15 degrees, the seal portion will become to be permanently deformed by being left as it is and therefore, it will become difficult to seal the toner. Also, if the rubber hardness of the seal portion 8*a* exceeds 55 degrees, the toner on the developing roller 4 will become liable to be stripped off. On the other hand, it is preferable that the rubber hardness of the wall portion 8*b*, and more particularly the toner supplying surface 8B, be 60-95 degrees. If the rubber hardness of the wall portion 8*b* is less than 60 degrees, the desired density will become difficult to obtain. Also, if the rubber hardness of the wall portion 8*b* exceeds 95 degrees, when the crush amount of the sponge is changed by the vibration or the like of the developing roller 4, it will become difficult for the sponge to follow it.

The material of the seal portion 8*a* and the wall portion 8*b* is not restricted to urethane foam, but use may be made of popular rubber, such as silicone rubber or ethylene propylene diene rubber (EPDM rubber), subjected to foaming. For example, the hardness of a foamed elastic member can be changed by changing the material thereof, or as will be described later, the foam diameter and foam density. It is preferable from the viewpoint of the prevention of the deformation, peeling, etc., due to an environmental fluctuation, that the seal portion 8*a* and the wall portion 8*b* joined together to thereby constitute the seal member 8 be formed of one and the same material.

Also, in the present embodiment, the open-cell sponge is used as the wall portion 8*b*, but the present invention is not restricted thereof. For example, it is also possible to use a closed-cell sponge. When the closed-cell sponge is used as the wall portion 8*b*, there is no communication of the foam and therefore, there is no outflow of the air. As the result, the toner pressure can be increased more than when the open-cell sponge is used as the wall portion 8*b*. Also, the seal portion 8*a* is not restricted to the open-cell sponge, but it is also possible to use a closed-cell sponge.

The toner urged against the developing roller 4 is passed between the developing roller 4 and the developing blade 6 by the rotation of the developing roller 4 in the direction indicated by the arrow A. At this time, the amount toner on the developing roller 4 is regulated by the developing blade 6 and is made into a thin layer and also, has triboelectric charges imparted thereto. In the toner supplying portion X, the toner is urged against the developing roller 4 with high pressure and therefore, charges can be sufficiently imparted to the toner and also, it becomes possible for much toner to be carried on the developing roller 4. As the result, much toner can be supplied to the photosensitive drum 21 and therefore, it becomes possible to satisfy the desired image density without increasing the peripheral speed of the supplying roller 5 more than necessary.

In the image forming apparatus 100 according to the present embodiment, the construction of the seal member 8 was variously changed and an image output endurance test of 1,000 sheets was carried out. A solid image (image of a maximum density level) was outputted for each 250 sheets, and image density was measured. The result is shown in Table 1 below.

TABLE 1

| peripheral speed of developing roller (mm/sec.) | peripheral speed of developer conveying member (mm/sec.) | hardness of seal portion | hardness of wall portion | evaluation | contents |
|---|---|---|---|---|---|
| 120 | 84 | 40 | 72 | ○ | |
| 120 | 84 | 20 | 62 | ○ | |
| 120 | 84 | 54 | 90 | ○ | |
| 120 | 84 | 12 | 70 | x | overflow of toner |
| 120 | 84 | 60 | 62 | x | clogging of toner |
| 120 | 84 | 50 | 50 | x | low density |
| 120 | 180 | 50 | 50 | ○ | |
| 120 | 84 | 40 | 98 | x | occurrence of streaks |

(Operation of the Developing Apparatus)

Subsequently, the operation of this developing apparatus 1 will be described. In the present embodiment, the gap between the developing roller 4 and the supplying roller 5 is 1.0 mm, and the peripheral speed of the supplying roller 5 is 70% of the peripheral speed of the developing roller 4. By the rotation of the agitating vane 3, the toner is supplied from the toner containing portion 2*a* to the developing chamber 2*b*. This toner is then conveyed by the rotation of the supplying roller 5 in the direction indicated by the arrow B. The toner conveyed by the supplying roller 5 is scraped off from the surface of the supplying roller 5 by the scraping member 7. This toner is collected in the space, i.e., the toner supplying portion X, closed (surrounded) by the developing roller 4, the seal member 8, the supplying roller 5 and further, the scraping member 7. Thus, the pressure of the toner in the toner supplying portion X is increased by the toner sequentially conveyed by the supplying roller 5.

Here, the rubber hardness of the wall portion 8*b* of the seal member 8 forming the toner supplying portion X is made higher than that of the seal portion 8*a*, whereby high toner pressure can be kept in the toner supplying portion X without the pressure being dispersed. Thus, the toner can be urged against the developing roller 4 with the high toner pressure and therefore, the toner amount capable of adhering to the developing roller 4 becomes great.

As shown in Table 1, according to the present embodiment, desired image density can be obtained without the peripheral speed of the supplying roller 5 being made higher than necessary. Also, it has been found that the rubber hardness of the seal portion 8*a* should preferably be 15-55 degrees, and the rubber hardness of the wall portion 8*b* should preferably be 60-95 degrees.

As described above, according to the present embodiment, the seal member 8 is constituted by the seal portion 8*a* and the wall portion 8*b* formed of sponges differing in rubber hardness from each other, and the rubber hardness of the surface (toner supplying surface) 8B thereof adjacent to the toner supplying portion X is made higher than the rubber hardness of the surface (seal surface) thereof 8A contacting with the developing roller 4. As a result, it is possible to make the collection of the toner on the developing roller 4 after the termination of the developing step and the high toner pressure in the toner supplying portion X for the toner supply to the developing roller 4 compatible. As the result, it becomes possible to obtain the desired image density without increasing the peripheral speed of the supplying roller 5 more than necessary. That is, according to the present embodiment, the capability of supplying the toner to the developing roller 4 can be increased by a simple construction.

Embodiment 5

Another embodiment of the present invention will now be described. The basic constructions and operations of a developing apparatus and an image forming apparatus according to the present embodiment are the same as those of Embodiment 4. Accordingly, elements substantially identical with or corresponding to those in Embodiment 4 in function and construction are given the same reference characters and need not be described in detail.

In Embodiment 4, the seal portion 8*a* and wall portion 8*b* of the seam member 8 are constituted by discrete members. In contrast, in the present embodiment, during the molding of a sponge, a skin layer formed in the boundary with a container (metal mold) is utilized to heighten the rubber hardness of that surface (toner supplying surface) 8A of the seal member 8 which is adjacent to the toner supplying portion X.

Further describing, in the present embodiment, the seal member 8, as a whole, as in Embodiment 4, has a seal portion (first area) 8*a* and a wall portion (second area) 8*b* formed of open-cell polyurethane foam. Here, in the present embodiment, the seal portion 8*a* and the wall portion 8*b* are molded integrally with each other. The seal member 8 is integrally molded, whereby it becomes possible to inexpensively manufacture the seal member 8 having surfaces differing in rubber hardness from each other.

Figure 15:
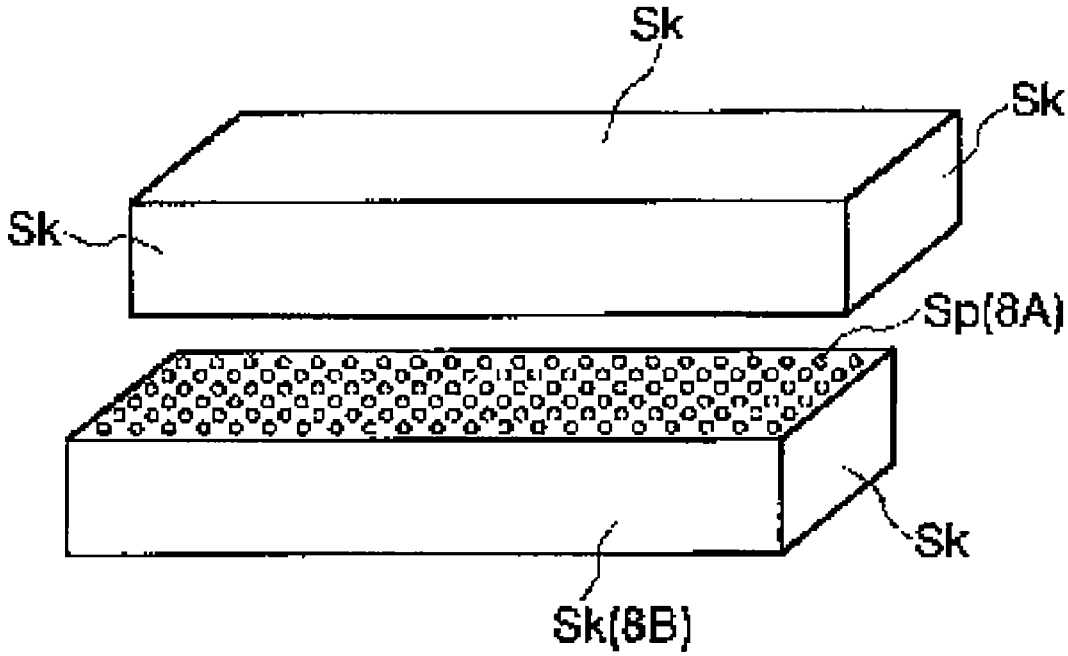
FIG. 15 is a typical view for illustrating a method of manufacturing an embodiment of a seal member constructed in accordance with the present invention.

That is, describing with reference to FIG. 15, the seal member 8 in the present embodiment is urethane foam foamed in a metal mold with polyole and isocianate mixed together in a metal mold container. If for example, a rectangular parallelepiped metal mold is used, a skin layer Sk will be formed along the inner surface of the metal mold shape. This formed urethane is cut into upper and lower parts as shown in FIG. 15, whereby it is possible to expose a foamed portion Sp in the interior of the sponge to the surface. Then, it is possible to use this portion Sp as the seal surface 8A of the seal portion 8*a*, and use a surface having the skin layer Sk as a surface differing from this foamed portion Sp, as the wall portion 8*b* (toner supplying surface 8B).

Here, it is preferable that the thickness of the skin layer Sk constituting the wall portion 8*b* be 50 μm or greater. If the thickness of the skin layer Sk is less than 50 μm, it will become difficult to obtain rubber hardness for heightening the toner pressure in the toner supplying portion X. However, even if the thickness of the skin layer Sk is less than 50 μm, it will be possible to further apply such resin as urethane resin or acryl resin as a reinforcing agent for the skin layer Sk, to thereby heighten the rubber hardness of the skin layer Sk.

In the present embodiment, the rubber hardness of the seal portion 8*a* was 50 degrees, and the rubber hardness of the wall portion 8*b* was 63 degrees. An evaluation similar to that in Embodiment 4 was carried out with a result that desired image density could be obtained with the peripheral speed of the supplying roller 5 being increased more than necessary.

As described above, according to the present embodiment, the seal member 8 is integrally molded with a sponge, and when this sponge is to be molded by the metal mold, the skin layer Sk formed by the metal mold is utilized as the wall portion 8*b* (the toner supplying surface 8B). Also, the section of the molded sponge is utilized as the seal surface 8A of the seal portion 8*a*. As a result, that surface (seal surface) 8A of the seal member 8 which contacts with the developing roll 4 and that surface (toner supplying surface) 8B thereof which is adjacent to the toner supplying portion X can be constituted by sponge differing in rubber hardness from each other to thereby make the rubber hardness of the toner supplying surface 8B higher than the rubber hardness of the seal surface 8*a*. Accordingly, as in Embodiment 4, it is possible to make the collection of the toner on the developing roller 4 after the termination of the developing step and the high toner pressure in the toner supplying portion X for the toner supply to the developing roller 4 compatible. As the result, it becomes possible to obtain the desired image density without increasing the peripheral speed of the supplying roller 5 more than necessary. Further, in the present embodiment, by integrally molding the seal member 8, it becomes possible to inexpensively manufacture the seal member 8 having surfaces differing in rubber hardness from each other.

Embodiment 6

Still another embodiment of the present invention will now be described. The basic constructions and operations of a developing apparatus and an image forming apparatus according to the present embodiment are the same as those of Embodiment 4. Accordingly, elements substantially identical with or corresponding to those in Embodiment 4 in function and construction are given the same reference characters and need not be described in detail.

In embodiment 5, the skin layer formed in the boundary with the container (metal mold) during the molding of the sponge was utilized to make the rubber hardness of the toner supplying surface 8B of the seal member 8 higher than that of the seal surface 8A thereof. In contrast, in the present embodiment, the foam diameter (mean cell diameter) of the sponge is changed in the molding of the sponge to thereby make the rubber hardness of the wall portion 8*b* more than that of the seal portion 8*a*.

Further describing, in the present embodiment, the seal member 8, as a whole, as in Embodiment 4, has a seal portion (first area) 8*a* and a wall portion (second area) 8*b* formed of open-cell polyurethane foam. Here, in the present embodiment, the seal portion 8*a* and the wall portion 8*b* are molded integrally with each other. By integrally molding the seal member 8, it becomes possible to inexpensively manufacture the seal member having surfaces differing in rubber hardness from each other.

In the present embodiment, the seal member 8 was manufactured by the following method. In this method, a foamed material of low hardness having an electrically conductive material dispersed therein is manufactured by piling up a plurality of foamed layers differing in mean cell diameter from one another.

Figure 16:
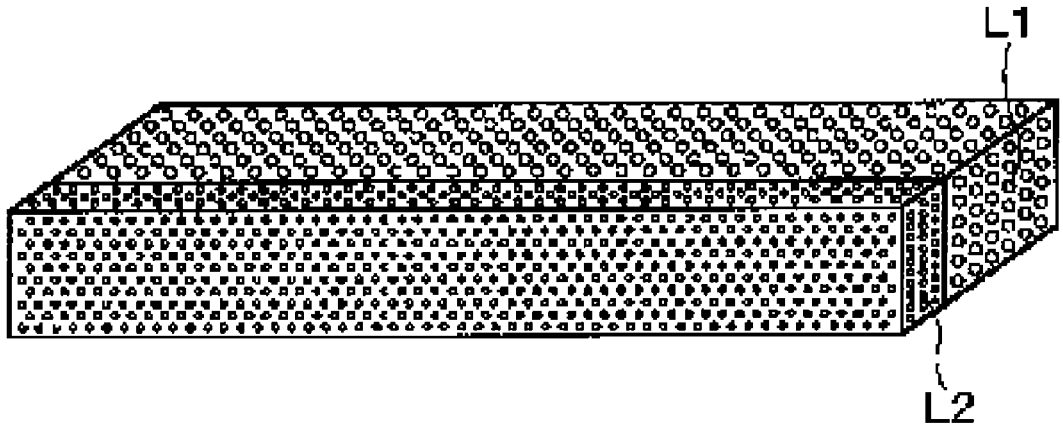
FIG. 16 is a typical view for illustrating the method of manufacturing an embodiment of the seal member constructed in accordance with the present invention.

Describing the embodiment with reference to FIG. 16, there is formed an unvulcanized and unfoamed lowermost urethane rubber layer having a compounding agent of a foaming agent and an electrically conductive material such as carbon black uniformly dispersed therein. This is set in the molding cabinet of a cube-shaped metal mold and is heated. As a result, the unvulcanized and unfoamed rubber layer is vulcanized and foamed and also, in the molding cabinet an electrically conductive sponge layer L1 is molded as per the metal mold. A gas generated by foaming passes through cells communicating with one another formed by the foaming and is discharged from a side of the metal mold.

Then, an unvulcanized and unfoamed rubber layer constituting an upper layer larger in mean cell diameter than the lower layer is formed on the lowermost sponge layer L1, and is heated in the molding cabinet to thereby form a sponge layer L2. As by polishing the surface of the sponge, it becomes possible to obtain the surfaces of the sponge having different cell diameters.

It is preferable that the layers L1 and L2 of the foamed material forming the seal portion 8*a* and the wall portion 8*b*, respectively, be formed of the same material (rubber material). That is, in a case where the environmental conditions under which the image forming operation is performed extremely differ from the ordinary room conditions (such as, for example, high-temperature and high-humidity conditions), if the rubber material differs, the coefficient of thermal expansion and the hygroscopic property will become different. Therefore, when the rubber material differs, there is conceivable the possibility that problems such as deformation and layer peeling may arise.

Besides the above-described manufacturing method, there is also a method of forming in a metal mold an unvulcanized and unfoamed rubber layer in which the amount of a forming agent has been changed in a vertical or horizontal direction, and effecting vulcanization by only one cycle of heating.

The material forming the sponge layers L1 and L2 should be selected in accordance with the use thereof. As a material generally used as an elastic (sponge) layer, mention may be made of urethane rubber, silicone rubber EPDM rubber, acryl rubber, nitrile rubber, hydrin rubber, fluorine resin or the like, but none of these materials is not particularly designated.

As the foaming agent, mention may generally be made of an inorganic foaming agent such as sodium bicarbonate, sodium carbonate or ammonium carbonate, or an organic foaming agent such as a nitroso-compound, an azo compound or a sulfonyl hydrazide compound, but none of these is particularly designated.

Also, it is possible to mix an electrically conducting agent for the adjustment of electrical resistance. The electrically conducting agent can be classified broadly into an electron electrically conducting agent and an ion electrically conducting agent. As the electron electrically conducting agent, mention may be made of carbon black, a metal oxide or the like, and as the ion electrically conducting agent, mention may be made of quaternary ammonium salt, aliphatic alcohol sulfate salt or the like, but none of these is particularly designated.

As regards the mean cell diameter of the sponge, 100 cells existing on the surface of a sample obtained by thinly slicing a foamed material was extracted, and the diameters of the respective cells were measured by an optical or electronic microscope, and the result was adopted as the mean value of the 100 cell diameters.

It is preferable that the mean cell diameter of the seal portion 8*a*, if it is that of open-cells, be 100-500 μm. If this mean cell diameter is less than 100 μm, there is the possibility that the rubber hardness may become too high. Also, if this mean cell diameter exceeds 500 μm, the toner may in some cases shoot out due to uneven abutting. On the other hand, it is preferable that the mean cell diameter of the wall portion 8*b* be 50-700 μm. If this mean cell diameter is less than 50 μm, manufacture will become difficult. Also, this mean cell diameter exceeds 700 μm, there is the possibility that the unevenness of the pressure by the longitudinal direction may occur as a density difference to an image.

In the image forming apparatus 100 according to the present embodiment, the construction of the seal member 8 was variously changed, and an evaluation similar to that described in Embodiment 4 was carried out. The result is shown in Table 2 below.

TABLE 2

| peripheral speed of developing roller (mm/sec.) | peripheral speed of developer conveying member (mm/sec.) | hardness of seal portion | hardness of wall portion | evaluation |
|---|---|---|---|---|
| 120 | 84 | 41 | 81 | ○ |
| 120 | 84 | 25 | 63 | ○ |
| 120 | 84 | 53 | 89 | ○ |

As shown in Table 2, again in the construction of the present embodiment, it is possible to obtain desired image density without making the peripheral speed of the supplying roller 5 higher than necessary.

As described above, according to the present embodiment, the seal member 8 is constituted by the seal portion 8*a* and the wall portion 8*b* formed of sponges having different cell diameters, and the rubber hardness of the surface (toner supplying surface) 8B adjacent to the toner supplying portion X is made higher than the rubber hardness of the surface (seal surface) 8A contacting with the developing roller 4. As a result, as in Embodiment 4, it is possible to make the collection of the toner on the developing roller 4 after the termination of the developing step and the high toner pressure in the toner supplying portion X for the toner supply to the developing roller 4 compatible. As the result, it becomes possible to obtain the desired image density without increasing the peripheral speed of the supplying roller 5 more than necessary. Further, in the present embodiment, the seal member 8 is integrally molded, whereby it becomes possible to inexpensively manufacture the seal member 8 having surfaces differing in rubber hardness from each other.

While, in the present embodiment, the cell diameter was changed to thereby change the rubber hardness, the present invention is not restricted thereto, but a similar effect can also be obtained by changing the foam density. Both the cell diameter and the foam density can be changed between the seal portion 8*a* and the wall portion 8*b*. The seal portion 8*a* and the wall portion 8*b* can differ in at least one of cell diameter and foam density from each other.

According to Embodiments 4 to 6 described above, the capability of supplying the developer to the developer carrying member can be increased by a simple construction. Also, as one of operational effects obtained by Embodiments 4 to 6, it may be mentioned that described image density can be obtained without the driving speed of the developer conveying member for conveying the developer to the developer supplying portion in which the supply of the developer to the developer carrying member is effected being increased more than necessary.

While the present invention has been described with respect to the specific embodiments thereof, it should be understood that the present invention is not restricted to the above-described embodiments.

For example, Embodiments 1 to 6 described above have been described as the developing apparatus 1 using the contact development in which the photosensitive drum 21 and the developing roller 4 contact with each other. The present invention, however, is not restricted thereto, but can be equally applied to a developing apparatus using the non-contact development in which the photosensitive drum 21 and the developing roller 4 are out of contact with each other.

Also, while in each of the above-described embodiments, a plate-shaped member is used as the scraping member 7, the present invention is not restricted thereto. For example, a portion of the seal member 8 may be made to abut against the supplying roller 5 to thereby scrape off the toner from the supplying roller 5. In this case, the toner supplying portion X is formed in a space surrounded by the developing roller 4, the seal member 8 and the supplying roller 5.

Also, Embodiments 1 to 6 described above are such that developing apparatuses are provided correspondingly to a plurality of image bearing members, or a plurality of developing apparatuses are provided for a single image bearing member, and can be equally applied, for example, to a color image forming apparatus capable of forming a full-color image. They can also be applied to an image forming apparatus which can directly superpose plural kinds (colors) of toner images one upon another on an image bearing member, or successively transfer them onto a transfer material to thereby directly superpose than one upon another on the transfer material, or superpose than one upon another or an intermediate transfer member, and thereafter transfer than to the transfer material to thereby output a full-color image or the like.

Further, the developing apparatus according to each of Embodiments 1 to 6 described above may be made into a cartridge detachably mountable with respect to an image forming apparatus main body (apparatus main body). As the cartridge, there is a developing cartridge which is made singly detachably mountable with respect to the apparatus main body. Also, as the cartridge, there is a process cartridge in which besides the developing apparatus, at least a photosensitive member is integrally made into a cartridge by a frame. The process cartridge may further have at least one of charging means and cleaning means. Such a cartridge detachably mountable with respect to the apparatus main body is detachably mounted on the apparatus main body through mounting means such as a mounting guide or a positioning member provided in the apparatus main body.

A specific example of a developer preferable as the developer used in the developing apparatus according to each of the above-described embodiments will now be shown.

As the developer, it is preferable to contain in a container a toner in which the value of a shape factor SF-1 representative of the degree of sphericity is 100-135, and the value of a shape factor SF-2 representative of the degree of irregularities is 100-120.

A description will be provided here of the degree of sphericity of the toner. It is possible to show the degree of sphericity of the toner by the use of the shape factors SF-1 and SF-2 of a toner particle. In the present invention, the shape factors SF-1 and SF-2 of the toner particle are defined as values obtained by sampling 100 toner images at random by the use of a scanning type electronic microscope FE-SEM (S-800) produced by Hitachi Works Ltd., introducing the image information thereof into an image analyzing apparatus (Luzex 3) produced by Nireco Corporation and effecting analysis, and calculating from the following expressions.

$$SF\text{-}1=\{(MXLNG)^2/AREA\}\times(\pi/4)\times100$$

$$SF\text{-}2=\{(PERI)^2/AREA\}\times(1/4\pi)\times100$$

(MXLNG: absolute maximum length, AREA: toner projection area, PERI: peripheral length)

The shape factor SF-1 of this toner particle indicates the degree of sphericity, and if it is greater than 135, the toner particle gradually becomes from sphericity to an amorphous shape. Also, the shape factor SF-2 of the toner particle indicates the degree of irregularities, and if it is greater than 120, irregularities will become remarkable on the surface of the toner particle. In perfect sphericity, SF-1=SF-2=100.

As the operational effect of the toner shape, the following may be mentioned. By making the shape of the toner spherical, the fluidity of the toner is improved, and the toner is smoothly supplied from the supplying roller 5, and the powder pressure in the space (developer supplying portion) between the sleeve 4 and the supplying roller 5 can be increased. As a result, the toner amount supplied to the sleeve 4 can be made sufficiently great, and the amount of toner used for development is increased. Therefore, even when an image having a large image area is to be developed, the occurrence of image inconveniences such as a reduction in image density, a blank area and uneven density can be prevented.

(Specific Example 1 of the Developer)

In this specific example, in the developing apparatus 1 of the already described embodiments, the following toner A1 which is a polymerized toner was used as the toner. A method of manufacturing the toner A1 is as follows.

In order to manufacture the polymerized toner, a water medium was first prepared. 450 g of 0.1 M-$Na_3PO_4$ water solution was thrown into 710 g of ion exchange water, and the mixture was heated to 60° C., and thereafter was agitated at 12,000 rpm by the use of a TK type homomixer (produced by Tokushu Kika Kogyo). 68 g of 1.0M—$CaCl_2$ water solution was gradually added to this to thereby obtain a water medium containing $Ca_3(PO_4)_2$.

Next, a polymerizable monomeric composition was prepared.

| | |
|---|---|
| Monomer: styrene | 165 g |
| n-butyl acrylate | 35 g |
| Colorant: C.I. pigment blue 15:3 | 15 g |
| Charging controlling agent: metal salicylic compound | 3 g |
| Polarity resin: saturated polyester (acid value 14, peak molecular weight: 8,000) | 10 g |
| Mold releasing agent: ester wax (fusing point 70° C.) | 50 g |

The raw material by the foregoing prescription was heated to 60° C., and was uniformly melted and dispersed at 12,000 rpm by the use of the TK type homomixer (produced by Tokushu Kika Kogyo). 10 g of polymerization starting agent 2,2'-azobis (2,4-dimethyl valeronitrile) was dissolved to thereby prepare a polymerizable monomeric compound.

The foregoing polymerizable monomeric composition was thrown into the obtained water medium, and the mixture was agitated under an $N_2$ environment of 60° C. at 10,000 rpm by the TK type homomixer for 10 minutes to thereby palletize the polymerizable monomeric composition. Thereafter, it was raised to 80° C. in temperature and was reacted for 10 hours while being agitated by a paddle agitating wing. After the termination of the polymerizing reaction, the residual monomer was removed under reduced pressure, and was cooled, whereafter hydrochloric acid was added thereto to thereby dissolve calcium phosphate. Thereafter, filtration, washing and drying were effected to thereby obtain colored suspended particles (polymerized toner particles).

100 parts by weight of obtained polymerized toner particles and 2.2 parts by weight of hydrophobic silica fine powder having a specific surface area of 200 $m^2/g$ by the BET method were mixed together to thereby prepare an extraneously processed toner A1. The obtained toner A1 had a weight mean particle diameter of 6.0 μm, a shape factor SF-1 of 115 and a shape factor SF-2 of 110.

The mean particle diameter and particle size distribution of the toner can be measured by one of various methods including a method using a Coulter Counter TA-II type or a Coulter multisizer (produced by Coulter Inc.). Here, they were measured by the method using a Coulter multisizer (produced by Coulter Inc.). The Coulter multisizer (produced by Coulter Inc.) had connected thereto an interface (produced by Nikkaki) outputting a number distribution and a volume distribution, and PC9801 personal computer (produced by NEC). As regards an electrolyte, 1% NaCl water solution was prepared by the use of first class sodium chloride. For example, ISOTON R-II (produced by Coulter Scientific Japan Co.) can be used.

As a measuring method, an interfacial active agent, preferably 0.1-5 mL of alkyl benzene sulfonate salt, as a dispersing agent is added to 100-150 mL of the foregoing electrolytic water solution, and further 2-20 mg of measurement sample as added thereto. The electrolyte having the sample suspended therein is subjected to a dispersing process by an ultrasonic disperser for about 1-3 minutes, and by the Coulter multisizer, the volume and number of toner particles of 2 μm or greater are measured by the use of an aperture of 100 μm as an aperture to thereby calculate the volume distribution and the number distribution. Then, the weight mean particle diameter of the volume reference found from the volume distribution, and the length mean particle diameter of the number reference found from the number distribution can be obtained.

(Specific Example 2 of the Developer)

As the developer, use can be made of a crushed toner shown in this Specific Example 2, besides the polymerized toner shown in Specific Example 1. As Specific Example 2, the following toner A3 which is a crushed toner was used as a toner A. A method of manufacturing the toner A3 is as follows.

| | |
|---|---|
| Styrene-acrylic resin | 100 parts by weight |
| Carbon Black | 5 parts by weight |
| Low molecular weight ethylene-propylene copolymer | 4 parts by weight |
| Negative charging controlling agent (azo dye metal complex) | 1 part by weight |

A mixture of the foregoing composition was melted and kneaded by a biaxial extruder heated to 140° C., and thereafter was roughly crushed by a hammer mill, and the roughly crushed material was finely crushed by a jet mill to thereby obtain a finely crushed material (crushed toner particles).

100 parts by weight of obtained crushed toner particles and 1.5 parts by weight of silica fine powder having a specific surface area of 200 $m^2/g$ by the BET method subjected to a hydrophobic process were mixed together to thereby prepare an extraneously processed toner A3. The obtained toner A3 had a weight mean particle diameter of 5.0 μm, a shape factor SF-1 of 145 and a shape factor SF-2 of 133.

Comparing the polymerized toner shown in Specific Example 1 and the crushed toner shown in Specific Example 2 with each other, it was more difficult for image density to be reduced when the polymerized toner was used. That is, the ease with which image density is reduced depends on the values of SF-1 and SF-2, and it is preferable that the value of SF-1 be 100-135 and the value of SF-2 be 100-120, and it has been confirmed that in such case, it is difficult for the image density to be reduced.

In Specific Example 1, there was shown an example in which a spherical toner is manufactured by a polymerizing method. When the toner is manufactured by a polymerizing method such as a suspension polymerizing method, a spherical toner of a desired shape can be obtained relatively easily without any special processing for sphericity being carried out. The present invention, however, is not restricted thereto, but the toner manufactured by a crushing method can be subjected to the processing for sphericity by a method of imparting a mechanical shock, a method of heating the toner in a hot air stream or like method to thereby obtain a spherical toner of a desired shape.

This application claims priority from Japanese Patent Applications No. 2005-140424 filed on May 12, 2005, No. 2005-140427 filed on May 12, 2005 and No. 2005-153113 filed on May 25, 2005, which are hereby incorporated by reference herein.

What is claimed is:

1. A developing apparatus comprising:

a developer carrying member, which carries a developer thereon;

a developer supplying member configured to supply the developer to said developer carrying member, said developer supplying member being disposed in a position in which a surface of said developer supplying member is out of contact with a surface of said developer carrying member in a closest position between said developer carrying member and said developer supplying member;

a scraping member, which contacts said developer carrying member upstream of the closest position with respect to a surface movement direction of said developer carrying member to scrape off the developer from said developer carrying member;

a holding portion configured to hold said scraping member, one end of said holding portion being connected to a developing frame, and the other end of said holding portion in contact with said developer supplying member, wherein a developer supplying portion is formed by being surrounded by said scraping member, said developer carrying member and said developer supplying member for supplying the developer from said developer supplying member to said developer carrying member; and a collecting passage configured to direct the developer scraped off by said scraping member in a direction away from the closest position.

2. A developing apparatus according to claim 1, further comprising a developer containing portion, which contains the developer therein, wherein the developer scraped off from said developer carrying member and passed through said collecting passage is returned to said developer containing portion by said developer supplying member.

3. A developing apparatus according to claim 1, wherein said holding portion is formed with an aperture forming said collecting passage.

4. A developing apparatus according to claim 3, wherein said holding portion is plate-shaped.

5. A developing apparatus according to claim 4, wherein said holding portion is composed of a resin film.

6. A developing apparatus according to claim 3, wherein said holding portion is formed integrally with said developing frame.

7. A developing apparatus according to claim 3, wherein said aperture is formed so as to correspond to an area except for opposite end portions in a longitudinal direction of said developer carrying member.

8. A developing apparatus according to claim 1, wherein said scraping member is a foamed elastic member.

9. A developing apparatus according to claim 8, wherein said scraping member is compressed and provided between said developer carrying member and said developer supplying member, and abuts against said developer carrying member by at least one corner portion of said scraping member.

10. A developing apparatus according to claim 1, wherein said scraping member is a plate-shaped member.

11. A developing apparatus according to claim 10, wherein said scraping member is composed of a resin film.

12. A developing apparatus according to claim 1, wherein at the closest position between said developer carrying member and said developer supplying member, a surface movement direction of said developer carrying member and a surface movement direction of said developer supplying member are opposite directions.

13. A developing apparatus according to claim 1, wherein the developer is such that SF-1 is 100 or greater and 135 or less, and SF-2 is 100 or greater and 120 or less.

* * * * *